United States Patent [19]

Matsuoka

[11] Patent Number: 4,905,469

[45] Date of Patent: Mar. 6, 1990

[54] AIR-FUEL RATIO FEEDBACK SYSTEM HAVING IMPROVED ACTIVATION DETERMINATION FOR AIR-FUEL RATIO SENSOR

[75] Inventor: Hiroki Matsuoka, Susono, Japan

[73] Assignee: Toyota Jidosha Kabushiki Kaisha, Aichi, Japan

[21] Appl. No.: 259,336

[22] Filed: Oct. 18, 1988

[30] Foreign Application Priority Data

Oct. 20, 1987 [JP] Japan ..... 62-262911

[51] Int. Cl.[4] ..... F02D 41/14

[52] U.S. Cl. ..... 60/274; 60/276; 60/285; 123/489

[58] Field of Search ..... 123/440, 489, 589, 479; 60/274, 276, 285

[56] References Cited

U.S. PATENT DOCUMENTS

| | | | |
|---|---|---|---|
| 3,938,075 | 2/1976 | Reddy | 60/285 |
| 3,939,654 | 2/1976 | Creps | 60/276 |
| 4,019,474 | 4/1977 | Nishimiya et al. | 60/276 |
| 4,027,477 | 6/1977 | Storey | 60/276 |
| 4,111,162 | 9/1978 | Norimatsu et al. | 123/489 |
| 4,127,088 | 11/1978 | Ezoe | 123/440 |
| 4,130,095 | 12/1978 | Bowler et al. | 123/440 |
| 4,177,787 | 12/1979 | Hattori et al. | 123/440 |
| 4,178,884 | 12/1979 | Norimatsu et al. | 123/489 |
| 4,202,301 | 5/1980 | Early et al. | 123/489 |
| 4,208,993 | 6/1980 | Peter | 60/276 |
| 4,235,204 | 11/1980 | Rice | 123/440 |
| 4,244,340 | 1/1981 | Herth et al. | 123/440 |
| 4,251,989 | 2/1981 | Norimatsu et al. | 123/440 |
| 4,401,086 | 8/1983 | Miyagi | 123/489 |
| 4,462,373 | 7/1984 | Kanno | 123/489 |
| 4,475,517 | 10/1984 | Kobayashi et al. | 123/489 |
| 4,502,443 | 3/1985 | Hasegawa et al. | 123/440 |
| 4,528,957 | 7/1985 | Jundt et al. | 123/489 |
| 4,539,958 | 9/1985 | Ito et al. | 123/440 |
| 4,561,400 | 12/1985 | Hattori | 123/478 |
| 4,571,683 | 2/1986 | Kobayashi et al. | 364/431.05 |
| 4,693,076 | 9/1987 | Chujo et al. | 60/274 |
| 4,707,985 | 11/1987 | Nagai et al. | 60/274 |
| 4,712,373 | 12/1987 | Nagai et al. | 60/274 |
| 4,720,973 | 1/1988 | Katsuno | 60/274 |
| 4,739,614 | 4/1988 | Katsuno et al. | 123/479 |

FOREIGN PATENT DOCUMENTS

| | | |
|---|---|---|
| 51-47486 | 4/1976 | Japan . |
| 52-43030 | 4/1977 | Japan . |
| 52-102934 | 8/1977 | Japan . |
| 53-5332 | 1/1978 | Japan . |
| 53-103796 | 9/1978 | Japan . |
| 55-5417 | 1/1980 | Japan . |
| 55-37562 | 3/1980 | Japan . |
| 55-156228 | 12/1980 | Japan . |
| 57-32772 | 7/1982 | Japan . |
| 57-32773 | 7/1982 | Japan . |
| 57-32774 | 7/1982 | Japan . |
| 58-27848 | 2/1983 | Japan . |
| 58-48755 | 3/1983 | Japan . |
| 58-48756 | 3/1983 | Japan . |
| 58-53661 | 3/1983 | Japan . |
| 58-72646 | 4/1983 | Japan . |
| 58-72647 | 4/1983 | Japan . |
| 58-135343 | 8/1983 | Japan . |
| 58-150038 | 9/1983 | Japan . |
| 58-150039 | 9/1983 | Japan . |
| 58-152147 | 9/1983 | Japan . |
| 59-32644 | 2/1984 | Japan . |
| 59-206638 | 11/1984 | Japan . |
| 60-1340 | 1/1985 | Japan . |
| 60-26138 | 2/1985 | Japan . |
| 60-53635 | 3/1985 | Japan . |
| 61-34330 | 2/1986 | Japan . |
| 61-53436 | 3/1986 | Japan . |
| 61-232346 | 10/1986 | Japan . |

OTHER PUBLICATIONS

Gogi (Technical Report) No. 87-5098, Apr. 20, 1987.

*Primary Examiner*—Andrew M. Dolinar
*Attorney, Agent, or Firm*—Oliff & Berridge

[57] ABSTRACT

In an air-fuel ratio feedback control system including at least one air-fuel ratio sensor downstream of or within a catalyst converter provided in an exhaust gas passage, an actual air-fuel ratio is controlled in accordance with the output of the air-fuel ratio sensor, which is supplied to a pull-up type input circuit. The determination of whether or not the air-fuel ratio sensor is activated is carried out by comparing the output of the pull-up type input circuit with two distinct levels, thus obtaining a hysteretic determination.

22 Claims, 21 Drawing Sheets

Fig. 6A PRIOR-ART
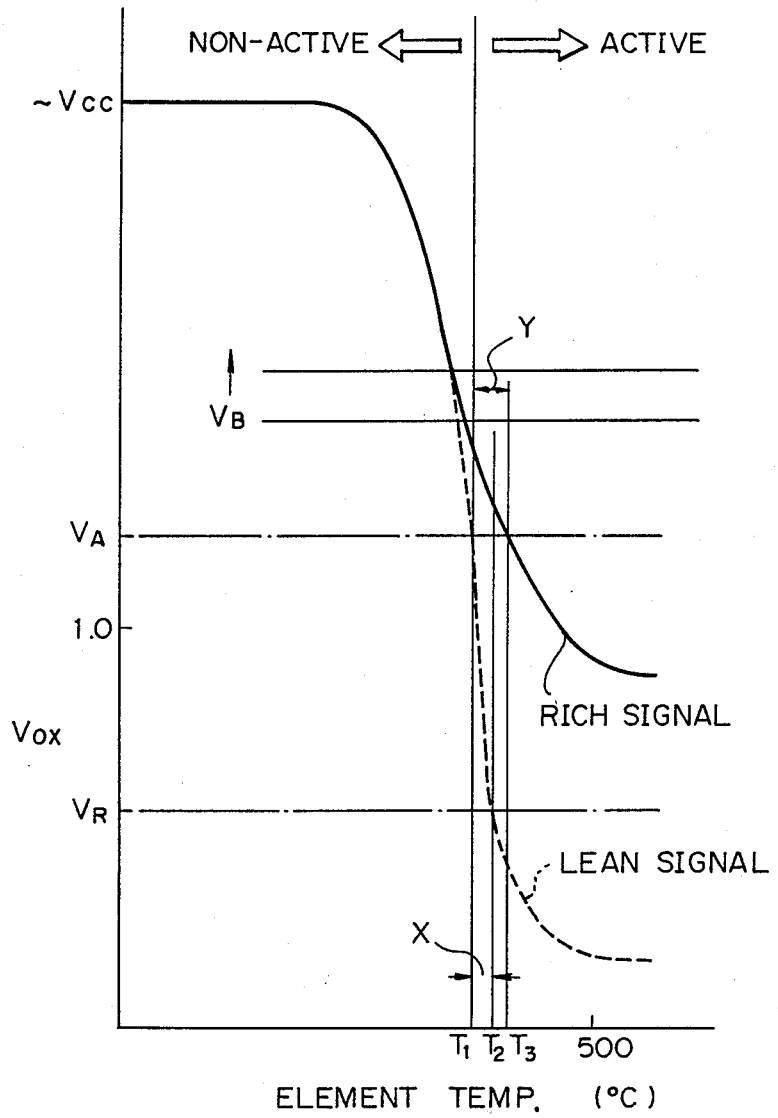

| Fig. 8 A | Fig. 8 B | Fig. 8 C |
|---|---|---|

LEAN
RICH
A/F
TDR
CDLY 0
t1
t2
t3
t4
t5
t6
t7
t8
TDL
A/F'
(F1)
TDR
(−TDL)

LEAN
RICH
TDR
KIR
FAF1

RSL
RSR
KIL

| Fig. 10A | Fig. 10B | Fig. 10C |
|---|---|---|

| Fig.14A | Fig.14B | Fig.14C |
|---|---|---|

AIR-FUEL RATIO FEEDBACK SYSTEM HAVING IMPROVED ACTIVATION DETERMINATION FOR AIR-FUEL RATIO SENSOR

BACKGROUND OF THE INVENTION (1) Field of the Invention

The present invention relates to a method and apparatus for feedback control of an air-fuel ratio in an internal combustion engine having at least one air-fuel ratio sensor downstream of or within a catalyst converter disposed within an exhaust gas passage.

(2) Description of the Related Art

Generally, in a feedback control of the air-fuel ratio sensor ($O_2$ sensor) system, a base fuel amount TAUP is calculated in accordance with the detected intake air amount and detected engine speed, and the base fuel amount TAUP is corrected by an air-fuel ratio correction coefficient FAF which is calculated in accordance with the output of an air-fuel ratio sensor (for example, an $O_2$ sensor) for detecting the concentration of a specific component such as the oxygen component in the exhaust gas. Thus, an actual fuel amount is controlled in accordance with the corrected fuel amount. The above-mentioned process is repeated so that the air-fuel ratio of the engine is brought close to a stoichiometric air-fuel ratio.

According to this feedback control, the center of the controlled air-fuel ratio can be within a very small range of air-fuel ratios around the stoichiometric ratio required for three-way reducing and oxidizing catalysts (catalyst converter) which can remove three pollutants CO, HC, and $NO_X$ simultaneously from the exhaust gas.

In the above-mentioned $O_2$ sensor system where the $O_2$ sensor is disposed at a location near the concentration portion of an exhaust manifold, i.e., upstream of the catalyst converter, the accuracy of the controlled air-fuel ratio is affected by individual differences in the characteristics of the parts of the engine, such as the $O_2$ sensor, the fuel injection valves, the exhaust gas recirculation (EGR) valve, the valve lifters, individual changes due to the aging of these parts, environmental changes, and the like. That is, if the characteristics of the $O_2$ sensor fluctuate, or if the uniformity of the exhaust gas fluctuates, the accuracy of the air-fuel ratio feedback correction amount FAF is also fluctuated, thereby causing fluctuations in the controlled air-fuel ratio.

To compensate for the fluctuation of the controlled air-fuel ratio, double $O_2$ sensor systems have been suggested (see: U.S. Pat. Nos. 3,939,654, 4,027,477, 4,130,095, 4,235,204). In a double $O_2$ sensor system, another $O_2$ sensor is provided downstream of the catalyst converter, and thus an air-fuel ratio control operation is carried out by the downstream-side $O_2$ sensor is addition to an air-fuel ratio control operation carried out by the upstream-side $O_2$ sensor. In the double $O_2$ sensor system, although the downstream-side $O_2$ sensor has lower response speed characteristics when compared with the upstream-side $O_2$ sensor, the downstream-side $O_2$ sensor has an advantage in that the output fluctuation characteristics are small when compared with those of the upstream-side $O_2$ sensor, for the following reasons.

(1) On the downstream side of the catalyst converter, the temperature of the exhaust gas is low, so that the downstream-side $O_2$ sensor is not affected b a high temperature exhaust gas.

(2) On the downstream side of the catalyst converter, although various kinds of pollutants are trapped in the catalyst converter, these pollutants have little affect on the downstream side $O_2$ sensor.

(3) On the downstream side of the catalyst converter, the exhaust gas is mixed so that the concentration of oxygen in the exhaust gas is approximately in an equilibrium state.

Therefore, according to the double $O_2$ sensor system, the fluctuation of the output of the upstream-side $O_2$ sensor is compensated by a feedback control using the output of the downstream-side $O_2$ sensor. Actually, as illustrated in FIG. 1, in the worst case, the deterioration of the output characteristics of the $O_2$ sensor in a single $O_2$ sensor system directly effects a deterioration in the emission characteristics. On the other hand, in a double $O_2$ sensor system, even when the output characteristics of the upstream-side $O_2$ sensor are deteriorated, the emission characteristics are not deteriorated. That is, in a double $O_2$ sensor system, even if only the output characteristics of the downstream-side $O_2$ are stable, good emission characteristics are still obtained.

As input circuits for the outputs of the $O_2$ sensor, use is made of a pull-down type circuit and a pull-up type circuit. The pull-down type input circuit is disadvantageous in that determination of the activation of the $O_2$ sensor is impossible when the base air-fuel ratio is lean, which will be later explained in detail.

On the other hand, the pull-up input circuit is advantageous in that determination of the activation of the $O_2$ sensor is possible even when the base air-fuel ratio is lean, but is disadvantageous in that determination of the activation of the $O_2$ sensor is erroneously carried out, especially when the $O_2$ sensor is used as a downstream-side $O_2$ sensor in a double $O_2$ sensor system or as an $O_2$ sensor downstream of or within the catalyst converter in a single $O_2$ sensor system, which will be also later explained in detail. As a result, after the determination of he $O_2$ sensor, the air-fuel ratio may be erroneously controlled, thus reducing the emission characteristics, the fuel consumption characteristics, the drivability characteristics, and the like.

SUMMARY OF THE INVENTION

An object of the present invention is to provide a double air-fuel ratio sensor system and a single air-fuel ratio sensor system using a pull-up input circuit for an air-fuel ratio sensor downstream of or within a catalyst converter, whereby the emission characteristics, the fuel consumption characteristics, the drivability characteristics, and the like are improved.

According to the present invention, an air-fuel ratio feedback control system including at least one air-fuel ratio sensor downstream of or within a catalyst converter provided in an exhaust gas passage, an actual air-fuel ratio is controlled in accordance with the output of the air-fuel ratio sensor, which is supplied to a pull-up type input circuit. The determination of whether or not the air-fuel ratio sensor is activated is carried out by comparing the output of the pull-up type input circuit with two distinct levels, thus obtaining a hysteretic determination.

BRIEF DESCRIPTION OF THE DRAWINGS

The present invention will be more clearly understood from the description as set forth below with reference to the accompanying drawings, wherein:

FIGS. 6A, 6B, and 6C are diagrams explaining the problems of the prior art activation determination system using a pull-up input circuit;

DESCRIPTION OF THE PREFERRED EMBODIMENTS

Figure 1:
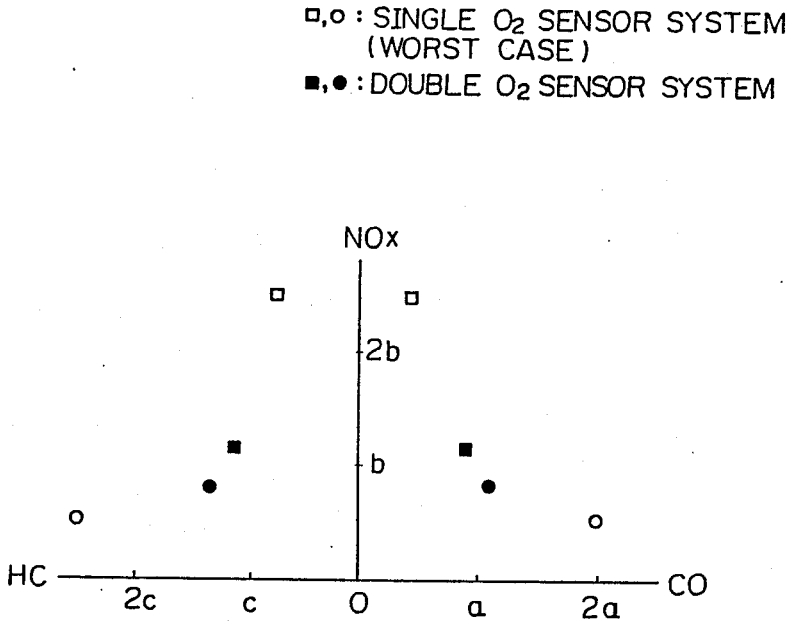
FIG. 1 is a graph showing the emission characteristics of a single $O_2$ sensor system and a double $O_2$ sensor system.
Figure 2:
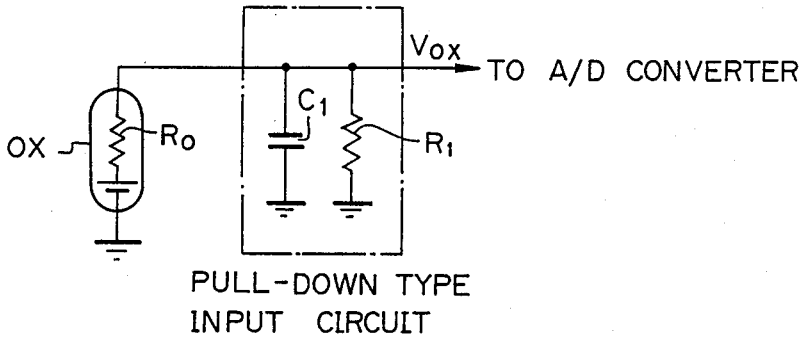
FIG. 2 is a circuit diagram illustrating an example of a pull-down input circuit for an $O_2$ sensor.
Figure 3:
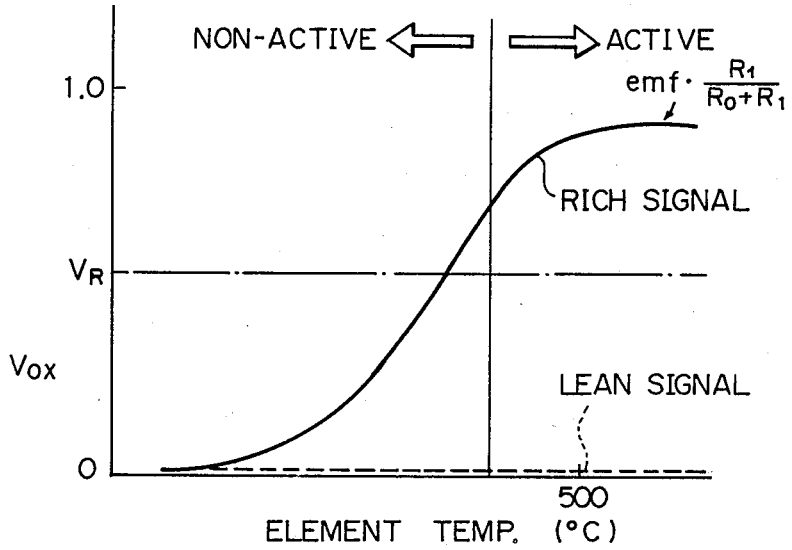
FIG. 3 is a diagram showing the output characteristics of the pull-down input circuit of FIG. 2.

A pull-down input circuit for the output $V_{OX}$ of an $O_2$ sensor OX is illustrated in FIG. 2 (see: Kogi (Technical Report) No. 87 - 5098, Innovation Society, Japan, Apr. 20, 1987). This pull-down type input circuit is comprised of a pull-down resistor $R_1$ and a capacitor $C_1$ for absorbing the noise. As illustrated in FIG. 3, when the element temperature of the $O_2$ sensor OX is low, the internal resistance $R_0$ thereof is large, and as a result, even when the base air-fuel ratio is rich and the electromotive force of the $O_2$ sensor OX is large, the output $V_{OX}$ of the $O_2$ sensor OX is still low. On the other hand, as illustrated in FIG. 4, when the element temperature of the $O_2$ sensor OX is high, the internal resistance $R_0$ thereof is small, and as a result, when the base air-fuel ratio is rich, the output $V_{OX}$ of the $O_2$ sensor OX is at a high level defined by $$V_{OX}=emf \cdot R_1/(R_0+R_1)$$

Where emf is the electromotive force.

When use is made of the above-mentioned pull-down type input circuit for the output of $O_2$ sensor, determination of the activation thereof is conventionally carried out by deciding whether or not the output $V_{OX}$ is higher than a predetermined value, or by deciding whether the output $V_{OX}$ is swung, i.e., once changed from a low level to a high level or vice versa. In this case, however, when the base air-fuel ratio is lean, it cannot be determined that the $O_2$ senor OX is activated, even when the $O_2$ sensor OX actually is activated.

Figure 4:
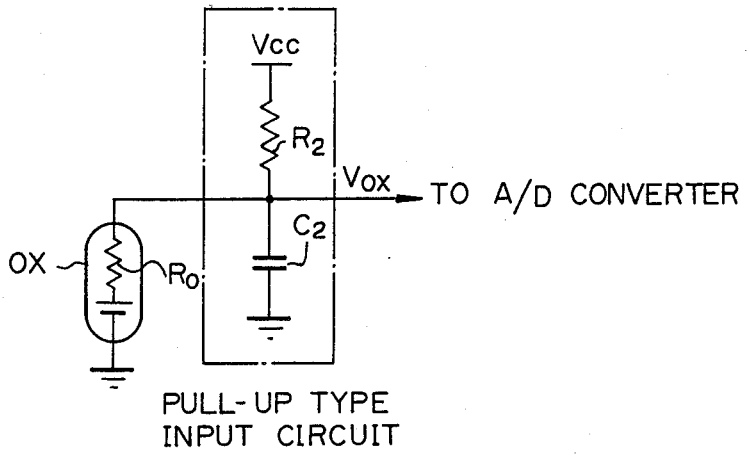
FIG. 4 is a circuit diagram illustrating an example of a pull-up input circuit for an $O_2$ sensor.
Figure 5:
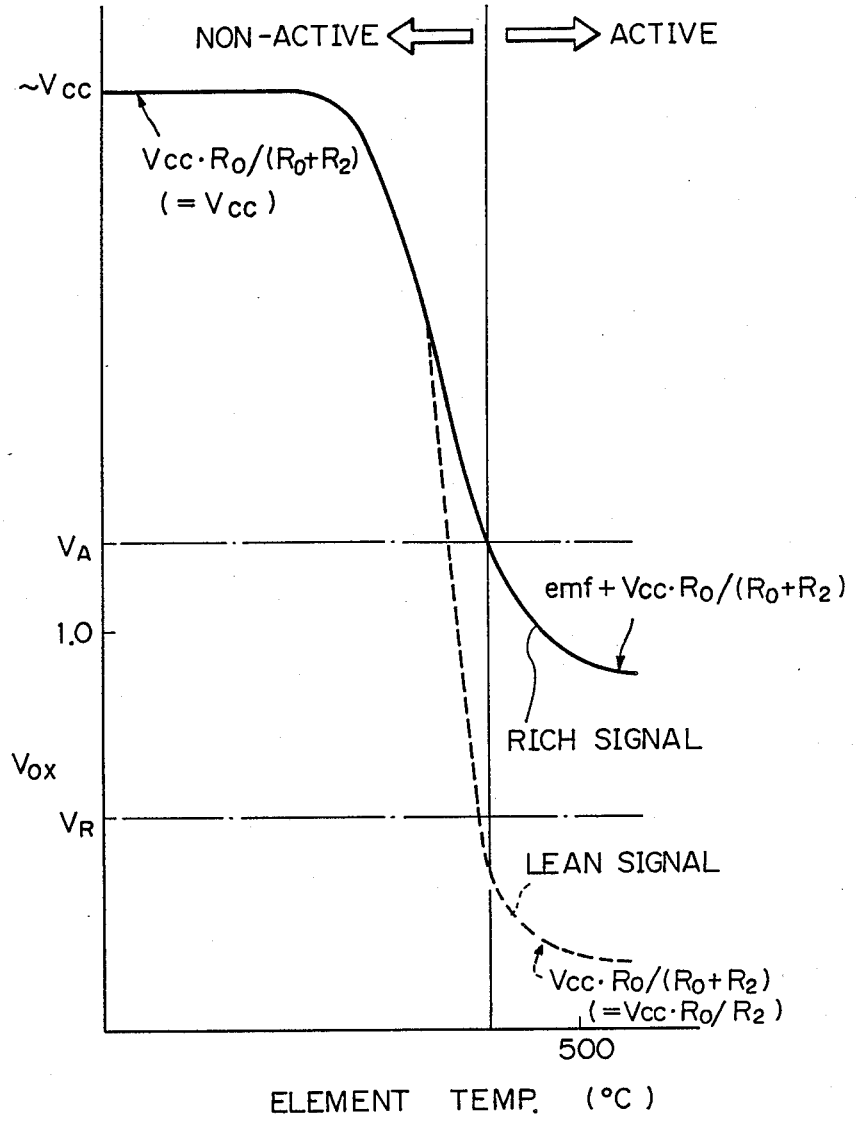
FIG. 5 is a diagram showing the output characteristics of the pull-up input circuit of FIG. 4.

There is also known a pull-up type input circuit for the output $V_{OX}$ of the $O_2$ sensor OX as illustrated in FIG. 4, which enables a determination of the activation of the $O_2$ sensor regardless of the base air-fuel ratio (see also the above-mentioned Giho (Technical Report)). That is, this pull-up type input circuit is comprised of a pull-up resistor $R_2$ and a capacitor $C_2$ the absorbing the noise. When the element temperature thereof is low, the internal resistance of the $O_2$ sensor OX is large compared with the resistance of the resistor $R_2$, and as a result, regardless of the base air-fuel ratio the output $V_{OX}$ of the $O_2$ sensor OX is pulled up to a definite level close to a power supply voltage $V_{cc}$ as illustrated in FIG. 5. This definite level is defined by $$V_{cc} \cdot R_0/(R_0+R_2) \simeq V_{cc}$$

On the other hand, when the element temperature of the $O_2$ sensor OX is high, the internal resistance $R_0$ thereof is small compared with that of the resistor $R_2$, and as a result, as illustrated in FIG. 5, when the base air-fuel ratio is rich, the output $V_{OX}$ of the $O_2$ sensor OX is $$emf+V_{cc} \cdot R_0/(R_0+R_2).$$

When the base air-fuel ratio is lean, the output $V_{OX}$ of the $O_2$ sensor OX is defined by $$V_{cc} \cdot R_0/(R_0+R_2) \simeq V_{cc} \cdot R_0/R_2.$$

Therefore, when use is made of the pull-up type input circuit for the output $V_{OX}$ of the $O_2$ sensor, determination of the activation of the $O_2$ sensor OX can be carried out by deciding whether or not the output $V_{OX}$ is higher than an activation level $V_A$, which is slightly higher than the rich output level of the $O_2$ sensor, after the engine is warmed-up.

In the above-mentioned double $O_2$ sensor system, however, when the above-mentioned pull-up type input circuit is applied to the downstream-side $O_2$ sensor, the following problems may occur. That is, since the activation determination level $V_A$ is not variable in accordance with the base air-fuel ratio, the air-fuel ratio is erroneously controlled by the determination of a rich state immediately after the activation determination when the base air-fuel ratio is lean. Also, even thereafter, hunting of the determination of activation and non-activation by the switching of the base air-fuel ratio from the rich side to the lean side or vice versa may occur, thus causing the controlled air-fuel ratio to be on the rich side. Referring to FIG. 6A, when the base air-fuel ratio is rich, determination of the activation of the $O_2$ sensor is made at the element temperature $T_3$, and when the base air-fuel ratio is lean, determination of the activation of the $O_2$ sensor is made at the element temperature $T_1$ lower than $T_3$. In the latter case, the air-fuel ratio is erroneously determined to be rich as indicated by a range X of the element temperature from $T_1$ to $T_2$, and as a result, the air-fuel ratio is erroneously controlled. Further, within a range Y of the element temperature from $T_1$ to $T_3$, the determination of activation and non-activation is in a hunting state in accordance with the base air-fuel ratio, thus creating an erroneous control of the air-fuel ratio.

Figure 6B:
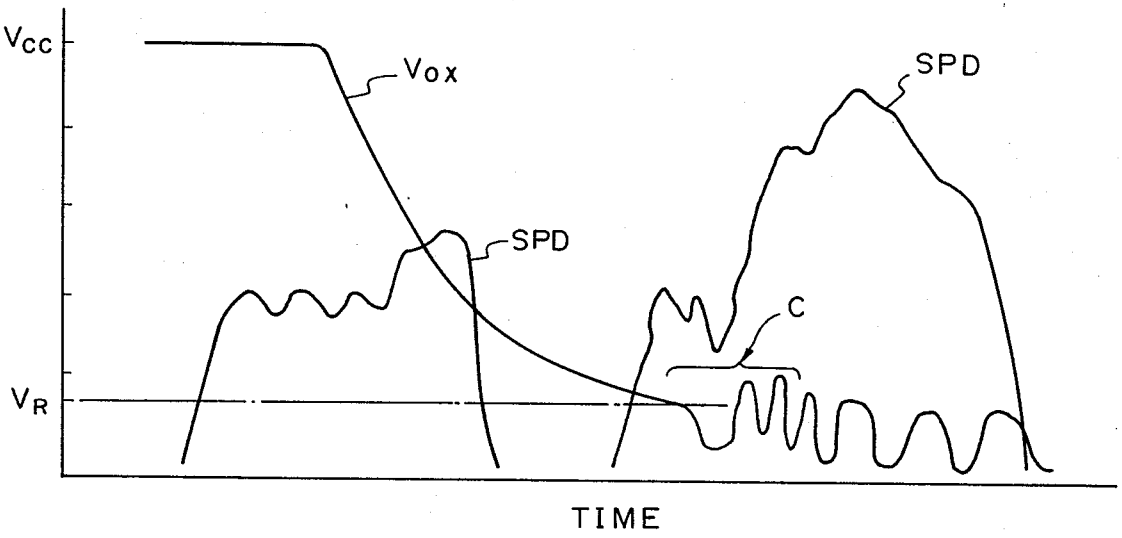
Fig. 6B PRIOR ART
Figure 6C:
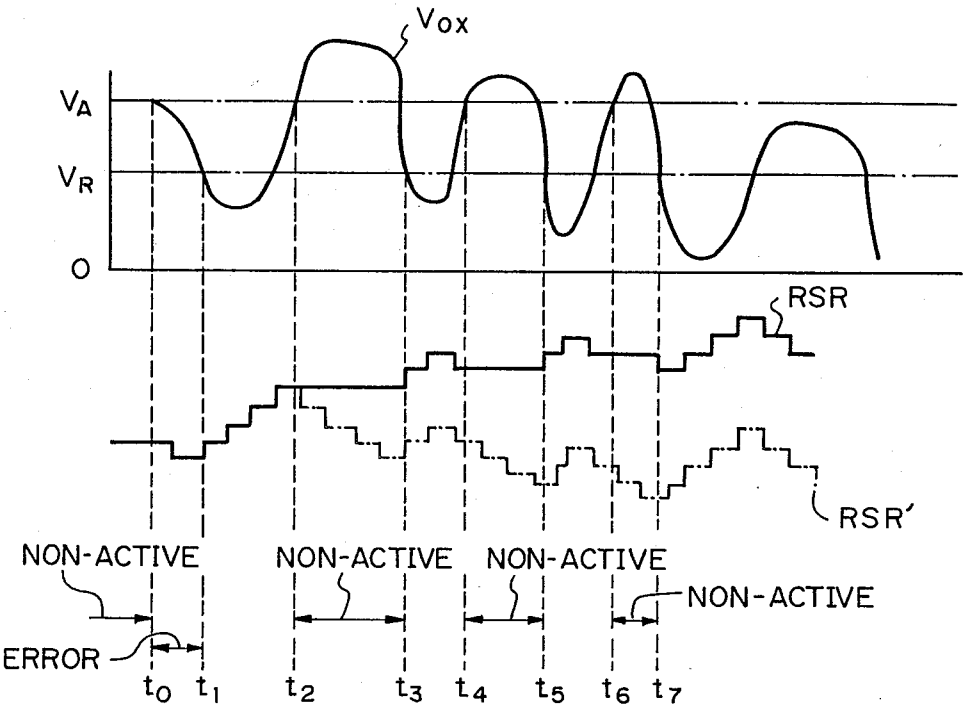
Fig. 6C PRIOR ART

Further, referring to FIG. 6B and FIG. 6C, which is an enlargement of part C of FIG. 6B, at a time $t_0$ when the downstream-side $O_2$ sensor is determined to be in an activation state ($V_{OX}<V_A$) under the condition that the base air-fuel ratio is lean, an air-fuel ratio feedback control by the output of the downstream-side $O_2$ sensor is started to change a rich skip amount RSR, for example. In this case, since the air-fuel ratio is erroneously determined to be on the rich side ($V_{OX}>V_R$), the rich skip amount RSR is controlled to the lean side. After that, at time $t_1$, the rich skip amount RSR is normally controlled to the rich side. Also, at an initial stage where the downstream-side $O_2$ sensor is activated, the fluctuation of the base air-fuel ratio is large enough to invite frequent non-activation states of the downstream-side $O_2$ sensor from $t_2$ to $t_3$, from $t_4$ to $t_5$, and from $t_6$ to $t_7$ as illustrated in FIG. 6C. In these non-activation states of the downstream-side $O_2$ sensor, the renewal of the rich skip amount RSR is stopped, and thus the rich skip amount RSR is overcorrected to the rich side. Note that a dotted line RSR, indicates the rich skip amount where the overcorrection to the rich side does not occur.

Further, to avoid the above-mentioned hunting of the determination of activation and non-activation, it may be suggested that the activation determination level $V_A$ is made high, but in this case, the term from $t_0$ to $t_1$ becomes long, thus further erroneously controlling the air-fuel ratio to the lean side. Also, the air-fuel ratio feedback control by the downstream side $O_2$ sensor may be often carried out at a semi-activation state of the downstream-side $O_2$ sensor, and thus it is impossible to increase the activation determination level $V_A$.

The above-mentioned problems will occur in a single $O_2$ sensor where an $O_2$ sensor is provided downstream of or within a catalyst converter.

Figure 7:
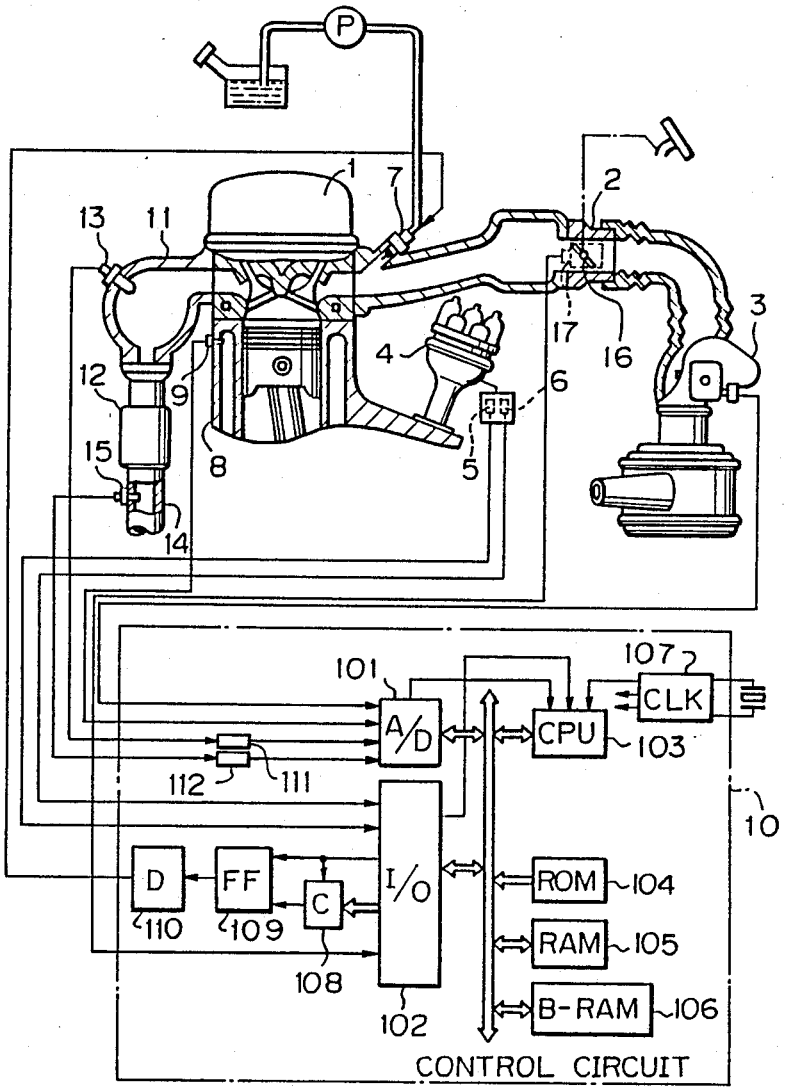
FIG. 7 is a schematic view of an internal combustion engine according to the present invention.

In FIG. 7, which illustrates an internal combustion engine according to the present invention, reference numeral 1 designates a four-cycle spark ignition engine disposed in an automotive vehicle. Provided in an air-intake passage 2 of the engine 1 is a potentiometer-type airflow meter 3 for detecting the amount of air drawn into the engine 1 to generate an analog voltage signal in proportion to the amount of air flowing therethrough. The signal of the airflow meter 3 is transmitted to a multiplexer-incorporating analog-to-digital (A/D) converter 101 of a control circuit 10.

Disposed in a distributor 4 are crank angle sensors 5 and 6 for detecting the angle of the crankshaft (not shown) of the engine 1.

In this case, the crank angle sensor 5 generates a pulse signal at every 720° crank angle (CA) and the crank-angle sensor 6 generates a pulse signal at every 30° CA. The pulse signals of the crank angle sensors 5 and 6 are supplied to an input/output (I/0) interface 102 of the control circuit 10. In addition, the pulse signal of the crank angle sensor 6 is then supplied to an interruption terminal of a central processing unit (CPU) 103.

Additionally provided in the air-intake passage 2 is a fuel injection valve 7 for supplying pressurized fuel from the fuel system to the air-intake port of the cylinder of the engine 1. In this case, other fuel injection valves are also provided for other cylinders, but are not shown in FIG. 7.

Disposed in a cylinder block 8 of the engine 1 is a coolant temperature sensor 9 for detecting the temperature of the coolant. The coolant temperature sensor 9 generates an analog voltage signal in response to the temperature THW of the coolant and transmits that signal to the A/D converter 101 of the control circuit 10.

Provided in an exhaust system on the downstream-side of an exhaust manifold 11 is a three-way reducing and oxidizing catalyst converter 12 which removes three pollutants CO, HC, and $N_{OX}$ simultaneously from the exhaust gas.

Provided on the concentration portion of the exhaust manifold 11, i.e., upstream of the catalyst converter 12, is a first $O_2$ sensor 13 for detecting the concentration of oxygen composition in the exhaust gas. Further, provided in an exhaust pipe 14 downstream of the catalyst converter 12 is a second $O_2$ sensor 15 for detecting the concentration of oxygen composition in the exhaust gas. The $O_2$ sensors 13 and 15 generate output voltage signals and transmit those signals via pull-up type input circuits 111 and 112, respectively, to the A/D converter 101 of the control circuit 10.

Reference 16 designates a throttle valve, and 17 an idle switch for detecting whether or not the throttle valve 16 is completely closed.

The control circuit 10, which may be constructed by a microcomputer, further comprises a central processing unit (CPU) 103, a read-only memory (ROM) 104 for storing a main routine and interrupt routines such as a fuel injection routine, an ignition timing routine, tables (maps), constants, etc., a random access memory 105 (RAM) for storing temporary data, a backup RAM 106, a clock generator 107 for generating various clock signals, a down counter 108, a flip-flop 109, a driver circuit 110, and the like.

Note that the battery (not shown) is connected directly to the backup RAM 106 and, therefore, the content thereof is not erased even when the ignition switch (not shown) is turned OFF.

The down counter 108, the flip-flop 109, and the driver circuit 110 are used for controlling the fuel injection valve 7. That is, when a fuel injection amount TAU is calculated in a TAU routine, which will be later explained, the amount TAU is preset in the down counter 108, and simultaneously, the flip-flop 109 is set. As a result, the driver circuit 110 initiates the activation of the fuel injection valve 7. On the other hand, the down counter 108 counts up the clock signal from the clock generator 107, and finally generates a logic "1" signal from the borrow-out terminal of the down counter 108, to reset the flip-flop 109, so that the driver circuit 110 stops the activation of the fuel injection valve 7. Thus, the amount of fuel corresponding to the fuel injection amount TAU is injected into the fuel injection valve 7.

Interruptions occur at the CPU 103 when the A/D converter 101 completes an A/D conversion and generates an interrupt signal; when the crank angle sensor 6 generates a pulse signal; and when the clock generator 107 generates a special clock signal.

The intake air amount data Q of the airflow meter 3 and the coolant temperature data THW of the coolant sensor 9 are fetched by an A/D conversion routine(s) executed at every predetermined time period and are then stored in the RAM 105. That is, the data Q and THW in the RAM 105 are renewed at every predetermined time period. The engine speed Ne is calculated by an interrupt routine executed at 30° CA, i.e., at every pulse signal of the crank angle sensor 6, and is then stored in the RAM 105.

Figures 8, 8A:
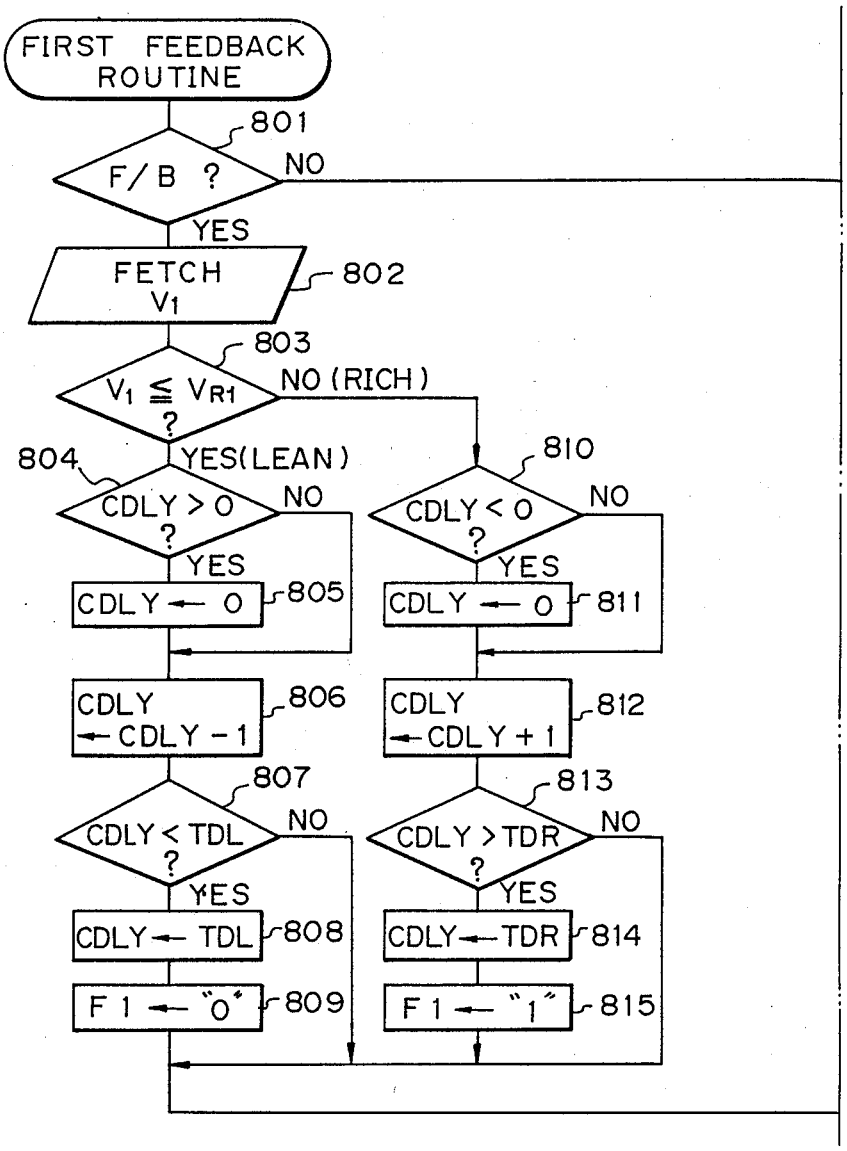
FIGS. 8, 8A-8C, 10, 10A-10C, 14, 14A-14C, and 16 are flow charts shown the operation of the control circuit of FIG. 7.
Figure 8B:
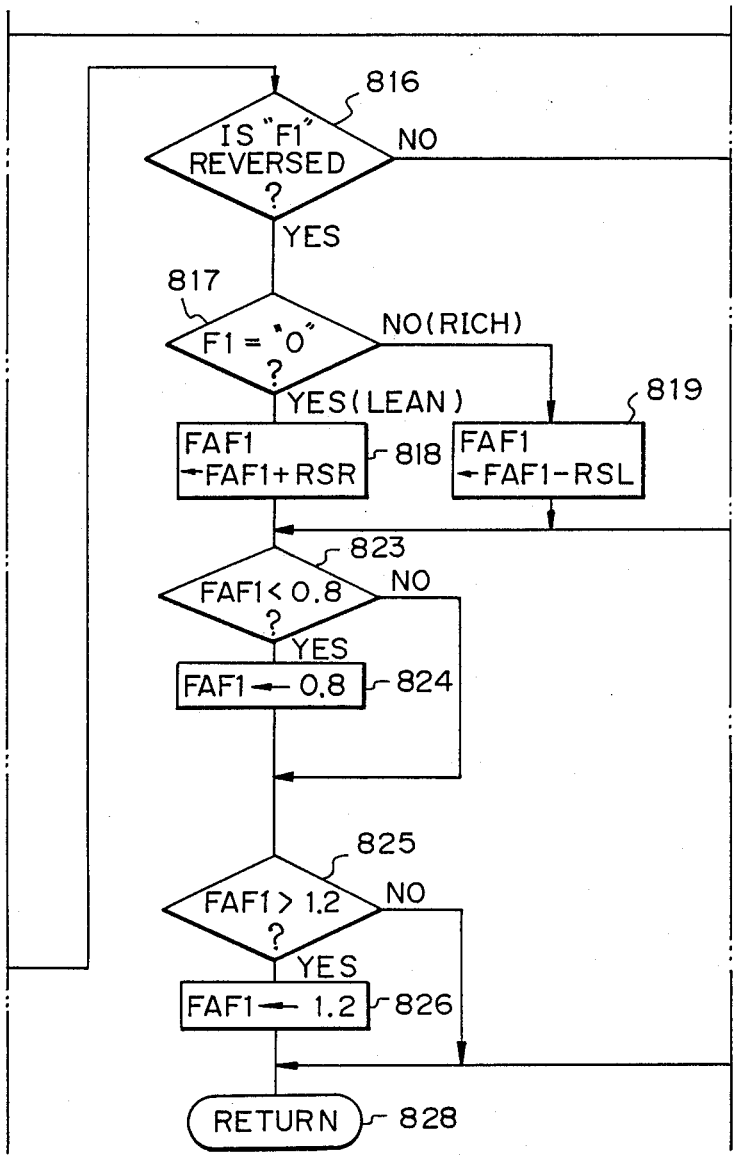
Figure 8C:
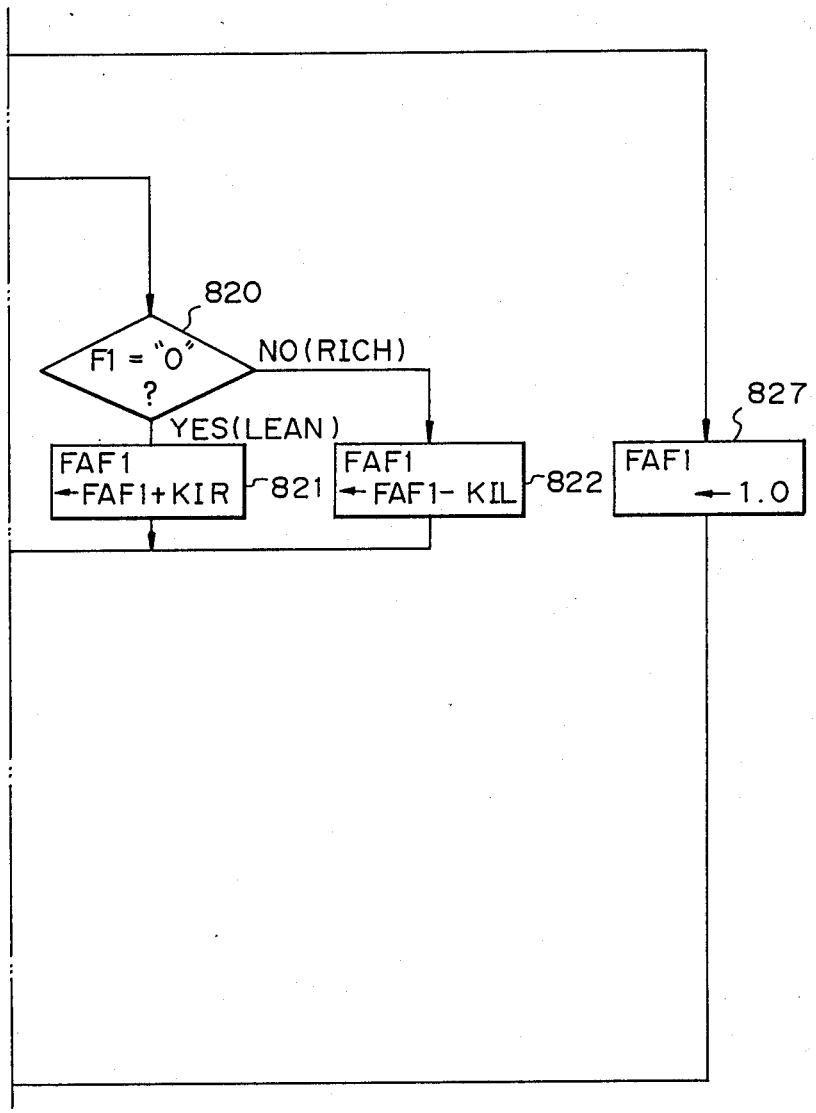

FIG. 8 is a routine for calculating a first air-fuel ratio feedback correction amount FAF1 in accordance with output of the upstream-side $O_2$ sensor 13 executed at every predetermined time period such as 4 ms.

At step 801, it is determined whether or not all of the feedback control (closed-loop control) conditions by the upstream-side $O_2$ sensor 13 are satisfied. The feedback control conditions are as follows:

(i) the engine is not in a fuel cut-off state;
(ii) the engine is not in a starting state;
(iii) the coolant temperature THW is higher than 50 ° C.,
(iv) the power fuel incremental amount FPOWER is 0; and
(v) the upstream-side $O_2$ sensor 13 is in an activated state.

Note that the determination of activation/non-activation of the upstream-side $O_2$ sensor 13 is carried out by determining whether or not the coolant temperature THW≧70° C., or by whether or not the output voltage $V_1$ of the upstream-side $O_2$ sensor 13, i.e., the output of the pull-up type input circuit 111, is lower than a predetermined value. Of course, other feedback control conditions are introduced as occasion demands, but an explanation of such other feedback control conditions is omitted.

If one of more of the feedback control conditions is not satisfied, the control proceeds to step 827, in which the amount FAF1 is caused to be 1.0 (FAF1=1.0), thereby carrying out an open-loop control operation. Note that, in this case, the amount FAF1 can be a value or a mean value immediately before the open-loop control operation. That is, the amount FAF1 or a mean value FAF1 thereof is stored in the backup RAM 106, and in an open-loop control operation, the value FAF1 of FAF1 is read out of the backup RAM 106.

Contrary to the above, at step 801, if all of the feedback control conditions are satisfied, the control proceeds to step 8O2.

At step 802, an A/D conversion is performd upon the output voltage $V_1$ of the upstream-side $O_2$ sensor 13, and the A/D converted value thereof is then fetched from the A/D converter 101. Then at step 603, the voltage $V_1$ is compared with a reference voltage $V_{R1}$ such as 0.45 V, thereby determining whether the current air-fuel ratio detected by the upstream-side $O_2$ sensor 13 is on the rich side or on the lean side with respect to the stoichiometric air-fuel ratio.

If $V_1 \leqq V_{R1}$, which means that the current air-fuel ratio is lean, the control proceeds to step 804, which determines whether or not the value of a delay counter CDLY is positive. If CDLY>0, the control proceeds to step 805, which clears the delay counter CDLY, and then proceeds to step 806. If CDLY≦0, the control proceeds directly to step 806. At step 806, the delay counter CDLY is counted down by 1, and at step 807, it is determined whether or not CDLY<TDL. Note that TDL is a lean delay time period for which a rich state is maintained even after the output of the upstream-side $O_2$ sensor 13 is changed from the rich side to the lean side, and is defined by a negative value. Therefore, at step 807, only when CDLY<TDL does the control proceed to step 808, which causes CDLY to be TDL, and then to step 808, which causes a first air-fuel ratio flag F1 to be "0" (lean state). On the other hand, if $V_1 > V_{R1}$, which means that the current air-fuel ratio is rich, the control proceeds to step 810, which determines whether or not the value of the delay counter CDLY is negative. If CDLY>0, the control proceeds to step 811, which clears the delay counter CDLY, and then proceeds to step 812. If CDLY≧0, the control directly proceeds to 812. At step 812, the delay counter CDLY is counted up by 1, and at step 813, it is determined whether or not CDLY>TDR. Note that TDR is a rich delay time period for which a lean state is maintained even after the output of the upstream-side $O_2$ sensor 13 is changed from the lean side to the rich side, and is defined by a positive value. Therefore, at step 813, only when CDLY>TDR does the control proceed to step 814, which causes CDLY to be TDR, and then to step 815, which causes the first air-fuel ratio flag F1 to be "1" (rich state).

Next, at step 816, it is determined whether or not the first air-fuel ratio flag F1 is reversed, i.e., whether or not the delayed air-fuel ratio detected by the upstream-side $O_2$ sensor 13 is reversed. If the first air-fuel ratio flag F1 is reversed, the control proceeds to steps 817 to 819, which carry out a skip operation.

At step 817, if the flag F1 is "0" (lean), the control proceeds to step 618, which remarkably increases the correction amount FAF1 by a skip amount RSR. Also, if the flag F1 is "1" (rich) at step 617, the control proceeds to step 819, which remarkably decreases the correction amount FAF1 by a skip amount RSL.

On the other hand, if the first air-fuel ratio flag F1 is not reversed at step 816, the control proceeds to steps 820 to 822, which carries out an integration operation. That is, if the flag F1 is "0" (lean) at step 820, the control proceeds to step 821, which gradually increases the correction amount FAF1 by a rich integration amount KIR. Also, if the flag F1 is "1" (rich) at step 820, the control proceeds to step 822, which gradually decreases the correction amount FAF1 by a lean integration amount KIL.

The correction amount FAF1 is guarded by a minimum value 0.8 at steps 823 and 824. Also, the correction amount FAF1 is guarded by a maximum value 1.2 at steps 825 and 826. Thus, the controlled air-fuel ratio is prevented from becoming overlean or overrich.

The correction amount FAF1 is then stored in the RAM 105, thus completing this routine of FIG. 8 at steps 828.

Figures 9A, 9B, 9C, 9D:
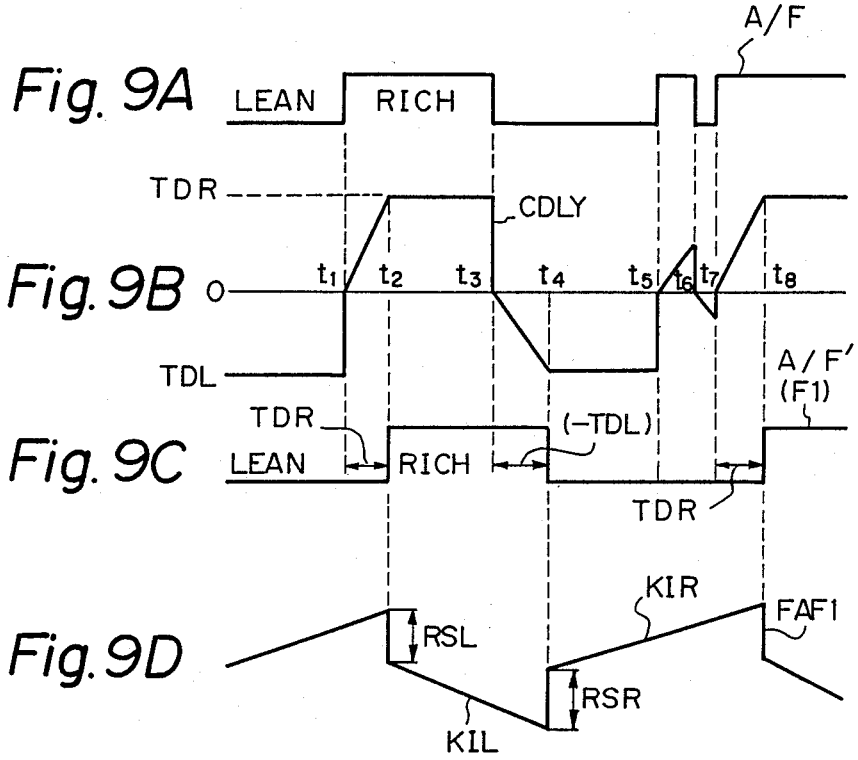
FIGS. 9A through 9D are timing diagrams explaining the flow chart of FIG. 8.

The operation by the flow chart of FIG. 8 will be further explained with reference to FIGS. 9A through 9D. As illustrated in FIG. 9A, when the air-fuel ratio A/F is obtained by the output $V_1$ of the upstream-side $O_2$ sensor 13, the delay counter CDLY is counted up during a rich state, and is counted down during a lean state, as illustrated in FIG. 9B. As a result, a delayed air-fuel ratio corresponding to the first air-fuel ratio flag F1 is obtained as illustrated in FIG. 9C. For example, at time $t_1$, even when the air-fuel ratio A/F is changed from the lean side to the rich side, the delayed air-fuel ratio A/F' (F1) is changed at time $t_2$ after the rich delay time period TDR. Similarly, at time $t_3$, even when the air-fuel ratio A/F is changed from the rich side to the lean side, the delayed air-fuel ratio F1', is changed at time $t_4$ after the lean delay time period TDL. However, at time $t_5$, $t_6$, or $t_7$, when the air-fuel ratio A/F is reversed within a shorter time period than the rich delay time period TDR or the lean delay time period TDL, the delay air-fuel ratio A/F', is reversed at time $t_8$. That is, the delayed air-fuel ratio A/F' is stable when compared with the air-fuel ratio A/F. Further, as illustrated in FIG. 9D, at every change of the delayed air-fuel ratio A/F' from the rich side to the lean side, or vice versa, the correction amount FAF is skipped by the skip amount RSR or RSL, and in addition, the correction amount FAF1 is gradually increased or decreased in accordance with the delayed air-fuel ratio A/F'.

Air-fuel ratio feedback control operations by the downstream-side $O_2$ sensor 15 will be explained. There are two types of air-fuel ratio feedback control operations by the downstream-side $O_2$ sensor 15, i.e., the operation type in which a second air-fuel ratio correction amount FAF2 is introduced thereinto, and the operation type in which an air-fuel ratio feedback control parameter in the air-fuel ratio feedback control operation by the upstream-side $O_2$ sensor 13 is variable. Further, as the air-fuel ratio feedback control parameter, there are nominated a delay time period TD (in more detail, the rich delay time period TDR and the lean delay time period TDL), a skip amount RS (in more detail, the rich skip amount RSR and the lean skip amount RSL), an integration amount KI (in more detail, the rich integration amount KIR and the lean integration amount KIL), and the reference voltage $V_{R1}$.

For example, if the rich skip amount RSR is increased or if the lean skip amount RSL is decreased, the controlled air-fuel ratio becomes richer, and if the lean skip amount RSL is increased or if the rich skip amount RSR is decreased, the controlled air-fuel ratio becomes leaner. Thus, the air-fuel ratio can be controlled by changing the rich skip amount RSR and the lean skip amount RSL in accordance with the output downstream-side $O_2$ sensor. Also, if the rich integration amount KIR is increased or if the lean integration amount KIL is decreased, the controlled air-fuel ratio becomes richer, and if the lean integration amount KIL is increased or if the rich integration amount KIR is decreased, the controlled air-fuel ratio becomes leaner. Thus, the air-fuel ratio can be controlled by changing the rich integration amount KIR and the lean integration amount KIL in accordance with the output of the downstream-side $O_2$ sensor 15. Further, if the rich delay time period becomes longer or if the lean delay time period becomes shorter, the controlled air-fuel becomes rich, and if the lean delay time period becomes longer or if the rich delay time period becomes shorter, the controlled air-fuel ratio becomes leaner. Thus, the air-fuel ratio can be controlled by changing the rich delay time period TDR1 and the lean delay time period - (-TDL) in accordance with the output of the downstream-side $O_2$ sensor 15. Still further, if the reference voltage $V_{R1}$ is increased, the controlled air-fuel ratio becomes richer, and if the reference voltage $V_{R1}$ is decreased, the controlled air-fuel ratio becomes leaner. Thus, the air-fuel ratio can be controlled by changing the reference voltage $V_{R1}$ in accordance with the output of the downstream-side $O_2$ sensor 15.

There are various merits in the control of the air-fuel ratio feedback control parameters by the output $V_2$ of the downstream-side $O_2$ sensor 15. For example, when the delay time periods TDR and TDL are controlled by the output $V_2$ of the downstream-side $O_2$ sensor 15, it is possible to precisely control the air-fuel ratio. Also, when the skip amounts RSR and RSL are controlled by the output $V_2$ of the downstream-side $O_2$ sensor 15, it is possible to improve the response speed of the air-fuel ratio feedback control by the output $V_2$ of the downstream-side $O_2$ sensor 15. Of course, it is possible to simultaneously control two or more kinds of the air-fuel ratio feedback control parameters by the output $V_2$ of the downstream-side $O_2$ sensor 15.

A double $O_2$ sensor system into which a second air-fuel ratio correction amount FAF2 is introduced will be explained with reference to FIGS. 10, 11, 12, and 13.

Figures 10, 10A:
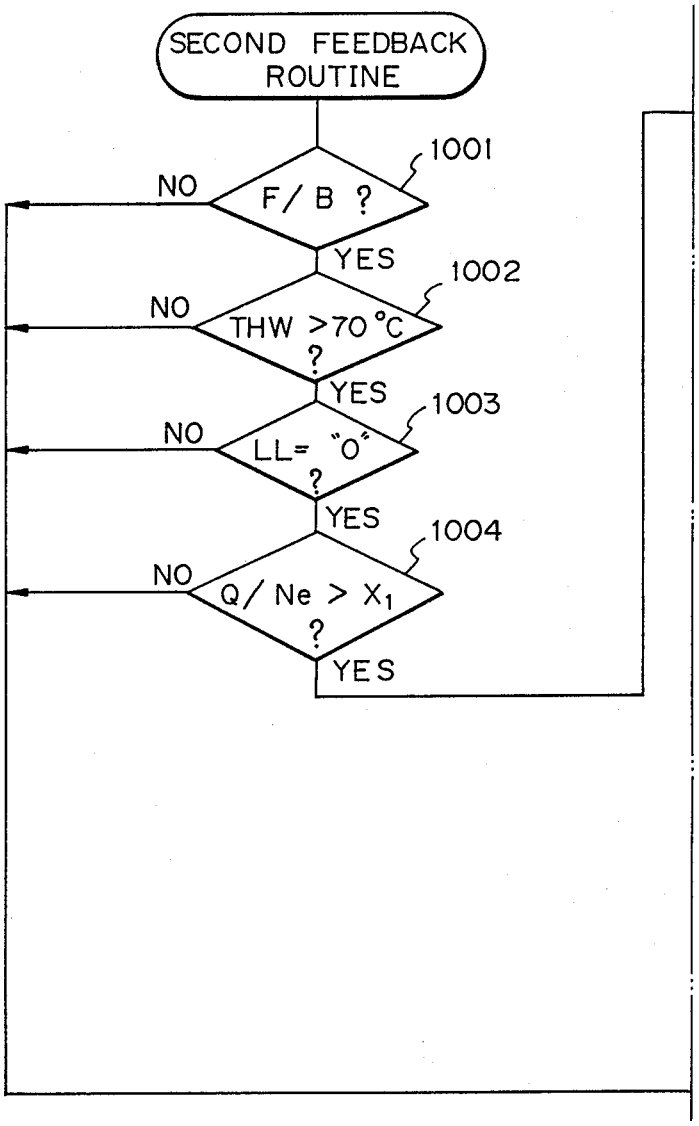
Figure 10B:
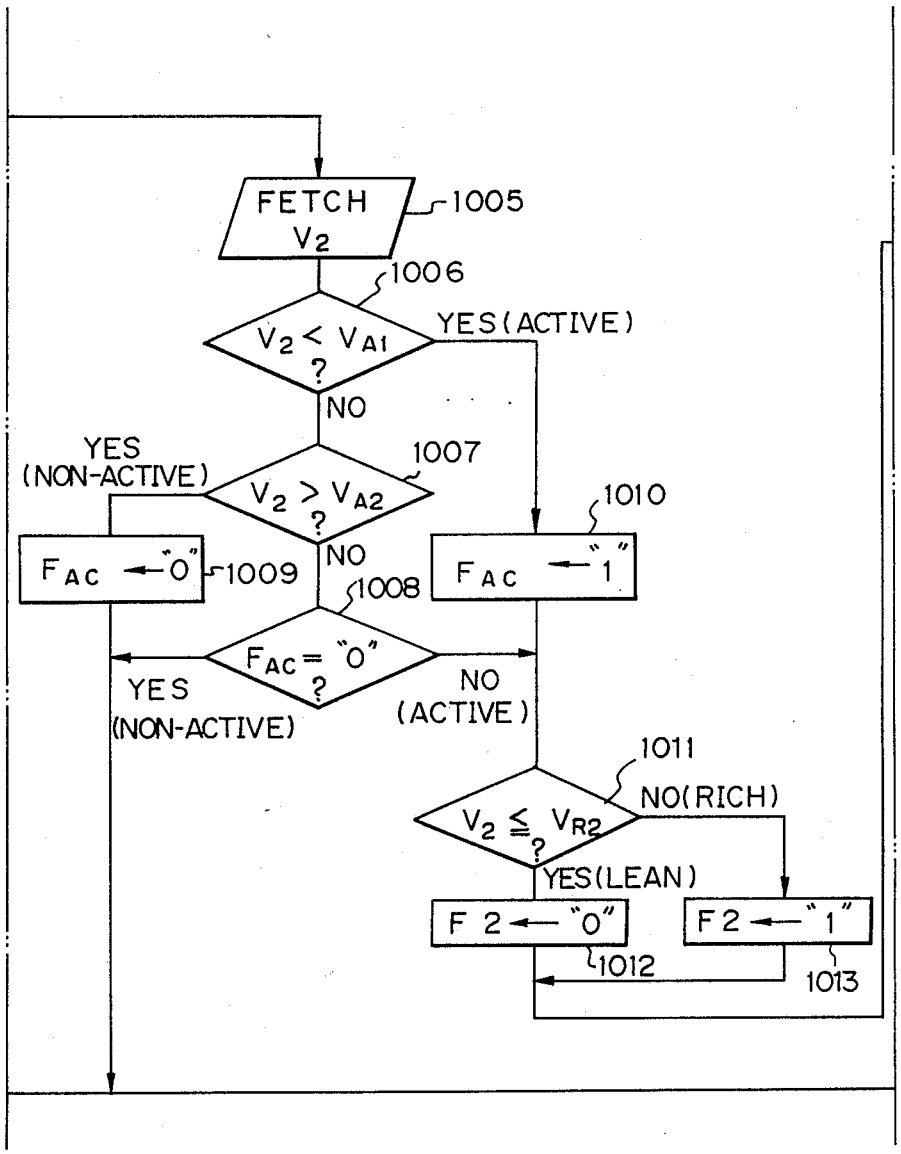
Figure 10C:
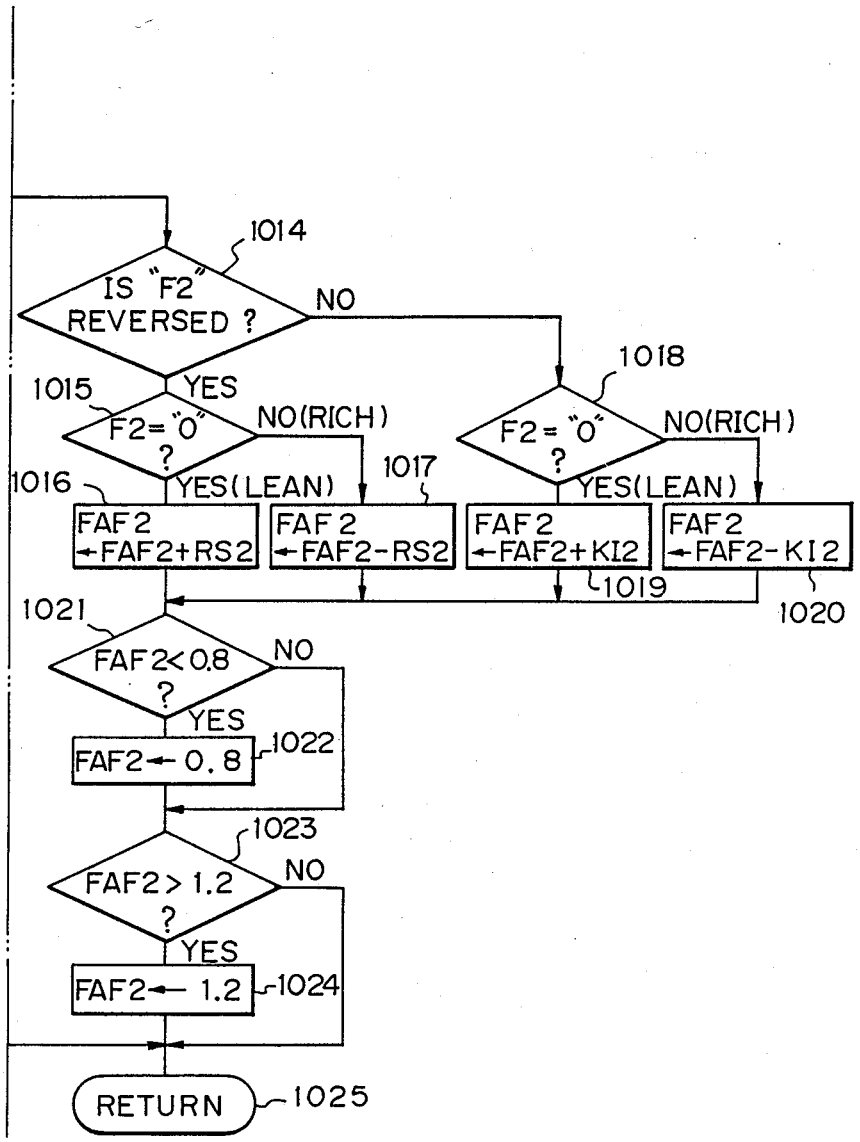

FIG. 10 is a routine for calculating a second air fuel ratio feedback correction amount FAF2 in accordance with the output of the downstream-side $O_2$ sensor 15 executed at every predetermined time period such as 1 s.

At steps 1001 through 1005, it is determined whether or not all of the feedback control (closed-loop control) conditions by the downstream-side $O_2$ sensor 15 are satisfied. For example, at step 1004, it is determined whether or not the feedback control conditions by the upstream-side $O_2$ sensor 13 are satisfied. At step 1002, it is determined whether or not the coolant temperature THW is higher than 70° C. At step 1003, it is determined whether or not the throttle valve 16 is open (LL="0"). At step 1004, it is determined whether or not a load parameter such as Q/Ne is larger than a predetermined value $X_1$. Of course, other feedback control conditions are introduced as occasion demands. For example, a condition of whether or not the secondary air suction system is driven when the engine is in a deceleration state, but an explanation of such other feedback control conditions is omitted.

If one or more of the feedback control conditions is not satisfied, the control directly proceeds to step 1025, thereby carrying out an open-loop control operation. Note that, in this case, the amount FAF2 or a mean value FAF2 thereof is stored in the backup RAM 106, and in an open-loop control operation, the value FAF2 or FAF2 is read out of the backup RAM 106.

Contrary to the above, if all of the feedback control conditions are satisfied, the control proceeds to step 1005.

Figure 11:
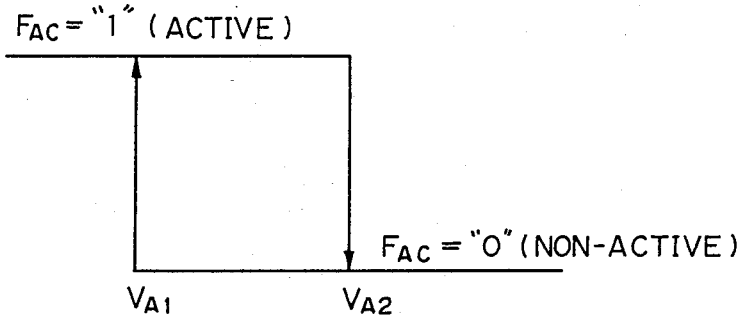
FIG. 11 is a graph showing the characteristics of the activation flag $F_{AC}$ of FIG. 10; and, FIGS. 12 and 15 are timing diagrams explaining the flow chart of FIGS. 10 and 14, respectively.

Steps 1005 through 1010 are provided for setting an activation flag $F_{AC}$ which shows an activation state of the downstream-side $O_2$ sensor 15, as illustrated in FIG. 11. That is, at step 1005, an A/D conversion is performed upon the output voltage $V_2$ of the downstream-side $O_2$ sensor 15, i.e., the output of the pull-up type input circuit 112, and the A/D converted value thereof is fetched from the A/D converter 101. At step 1006, it is determined whether or not the voltage $V_2$ is lower than a first activation determination level $V_{A1}$, and at step 1007, it is determined whether or not the voltage $V_2$ is higher than a second activation determination level $V_{A2}(>V_{A1})$. As a result, if $V_2<V_{A1}$, the control proceeds to step 1010, which sets the activation flag $F_{AC}$ (activation state), and if $V_2>V_{A2}$, the control proceeds to step 1009 which resets the activation flag $F_{AC}$ (non-activation state). Otherwise, the activation flag $F_{AC}$ is not changed and the control proceeds to step 1008, which determines whether or not the activation flag $F_{AC}$ is "0" (non-activation state). Only when $F_{AC}$ is "1" (activation state) does the control proceed to steps 1011 through 1013, otherwise the control proceeds directly to step 1025. At step 1011, the voltage $V_2$ is compared with a reference voltage $VR_2$ such as 0.55 V, thereby determining whether the current air-fuel ratio detected by the downstream-side $O_2$ sensor 15 is on the rich side or on the lean side with respect to the stoichiometric air-fuel ratio. Note that the reference voltage $VR_2(=0.55\ V)$ is preferably higher than the reference voltage $V_{R1}(=0.45\ V)$, in consideration of the difference in output characteristics and deterioration speed between the $O_2$ sensor 13 upstream of the catalyst converter 12 and the $O_2$ sensor 15 downstream of the catalyst converter 12. However, the voltage $V_{R2}$ can be voluntarily determined.

At step 1011, if the air-fuel ratio downstream of the catalyst converter 12 is lean, the control proceeds to step 1012 which resets a second air-fuel ratio flag F2. Alternatively, the control proceeds to the step 1013, which sets the second air-fuel ratio flag F2.

Next, at step 1014, it is determined whether or not the second air-fuel ratio flag F2 is reversed. If the second air-fuel ratio flag F2 is reversed, the control proceeds to steps 1015 to 1017 which carry out a skip operation. That is, if the flag F2 is "0" (lean) at step 1015, the control proceeds to step 1016, which remarkably increases the second correction amount FAF2 by a skip amount RS2. Also, if the flag F2 is "1" (rich) at step 1015, the control proceeds to step 1017, which remarkably decreases the second correction amount FAF2 by the skip amount RS2. On the other hand, if the second air-fuel ratio flag F2 is not reversed at step 1014, the control proceeds to steps 1018 to 1020, which carry out an integration operation. That is, if the flag F2 is "0" (lean) at step 1018, the control proceeds to step 1019, which gradually increases the second correction amount FAF2 by an integration amount KI2. Also, if the flag F2 is "1" (rich) at step 1018, the control proceeds to step 1020, which gradually decreases the second correction amount FAF2 by the integration amount KI2.

Note that the skip amount RS2 is larger than the integration amount KI2.

The second correction amount FAF2 is guarded by a minimum value 0.8 at steps 1021 and 1022, and by a maximum value 1.2 at steps 1023 and 1024, thereby also preventing the controlled air-fuel ratio from becoming overrich or overlean.

The correction amount FAF2 is then stored in the backup RAM 106, thus completing this routine of FIG. 10 at step 1025.

Figure 12:
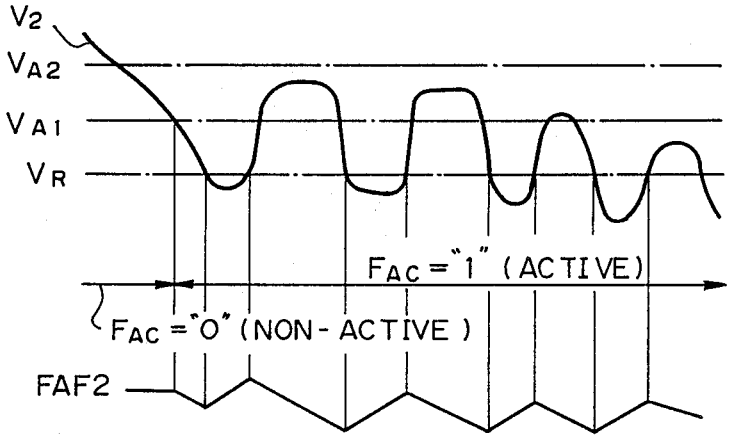

According to the routine of FIG. 10, as illustrated in FIG. 12, when the output $V_2$ of the downstream-side $O_2$ sensor 15, i.e., the output of the pull-up type input circuit 112, is changed so that $V_2 < V_{A1}$ is satisfied, the downstream-side $O_2$ sensor 15 is determined to be in an activation state ($F_{AC}$="1"). Nevertheless, unless $V_2 > V_{A2}$ is satisfied, the downstream-side $O_2$ sensor 15 is determined to be in a non-activation state. Therefore, the second air-fuel ratio correction amount FAF2 cannot be overcorrected to the rich side. Note that, if the first activation level $V_{A1}$ is further reduced, the duration wherein an erroneous determination of a rich state immediately after $V_2 < V_{A1}$ is satisfied, can be also reduced.

Note that $V_{A1}$ is set at a level which is slightly higher than a rich state level of the downstream-side $O_2$ sensor 15 after the engine is warmed-up. Also, $V_{A2}$ is set at a level which is higher than $V_{A1}$ and by which the hunting of determination of activation and non-activation is suppressed. For example, $V_{A2}$ is set at a level indicated by $V_B$ in FIG. 6A or slightly higher than this level $V_B$.

Figure 13:
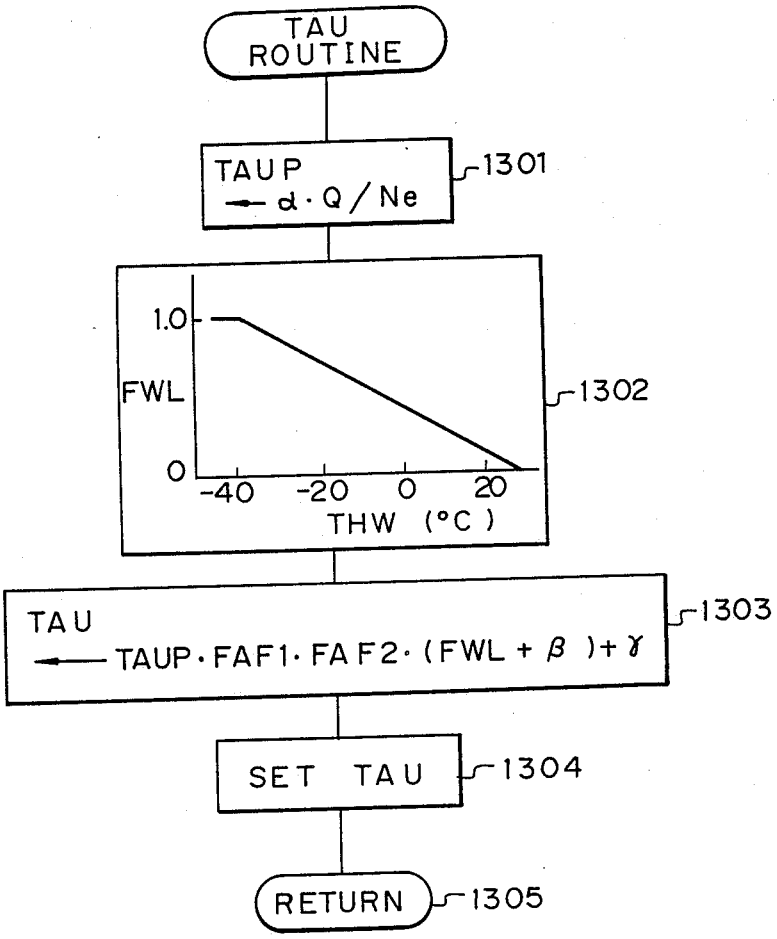

FIG. 13 is a routine for calculating a fuel injection amount TAU executed at every predetermined crank angle such as 360° CA. At step 1301, a base fuel injection amount TAUP is calculated by using the intake air amount data Q and the engine speed data Ne stored in the RAM 105. That is, $$TAUP \leftarrow \alpha \cdot Q/Ne$$

where $\alpha$ is a constant. Then at step 1302, a warming-up incremental amount FWL is calculated from a one-dimensional map stored in the ROM 104 by using the coolant temperature data THW stored in the RAM 105. Note that the warming-up incremental amount FWL decreases when the coolant temperature THW increases. At step 1303, a final fuel injection amount TAU is calculated by $$TAU \leftarrow TAUP \cdot FAF1 \cdot FAF2 \cdot (FWL + \beta) + \gamma$$

where $\beta$ and $\gamma$ are correction factors determined by other parameters such as the voltage of the battery and the temperature of the intake air. At step 1304, the final fuel injection amount TAU is set in the down counter 107, and in addition, the flip-flop 108 is set to initiate the activation of the fuel injection valve 7. Then, this routine is completed by step 1305. Note that, as explained above, when a time period corresponding to the amount TAU has passed, the flip-flop 109 is reset by the borrow-out signal of the down counter 108 to stop the activation of the fuel injection valve 7.

A double $O_2$ sensor system, in which an air-fuel ratio feedback control parameter of the first air-fuel ratio feedback control by the upstream-side $O_2$ sensor is variable, will be explained with reference to FIGS. 14, 15, and 16. In this case, the skip amounts RSR and RSL as the air-fuel ratio feedback control parameters are variable.

Figures 14, 14A:
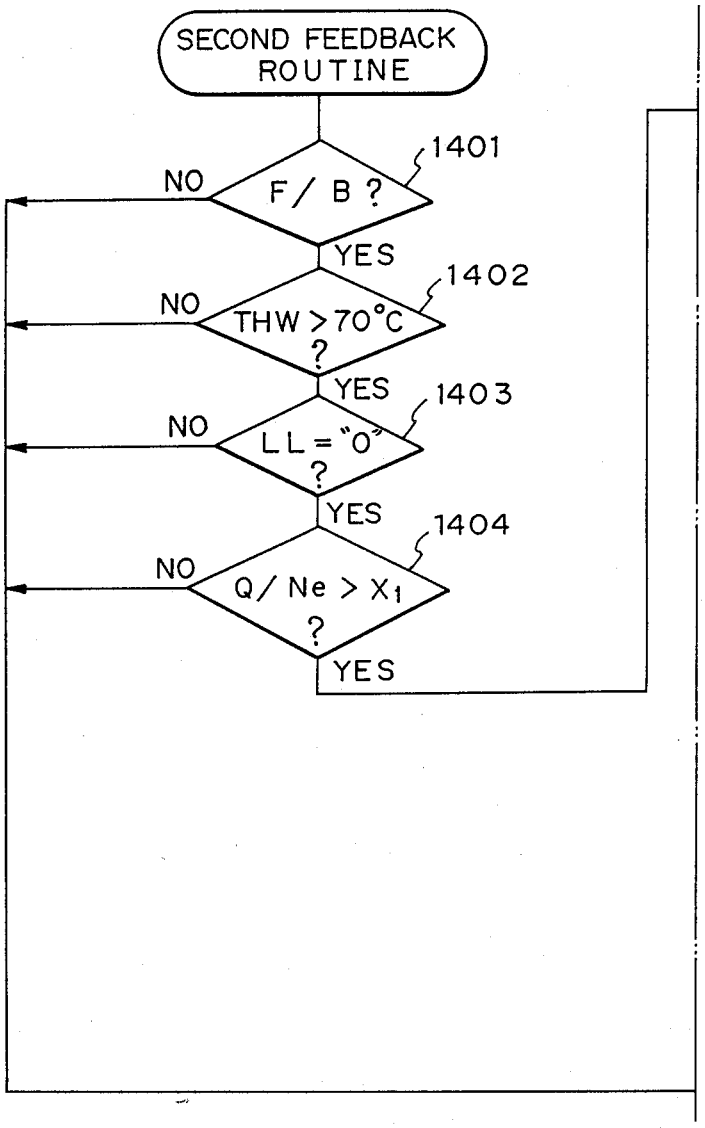
Figure 14B:
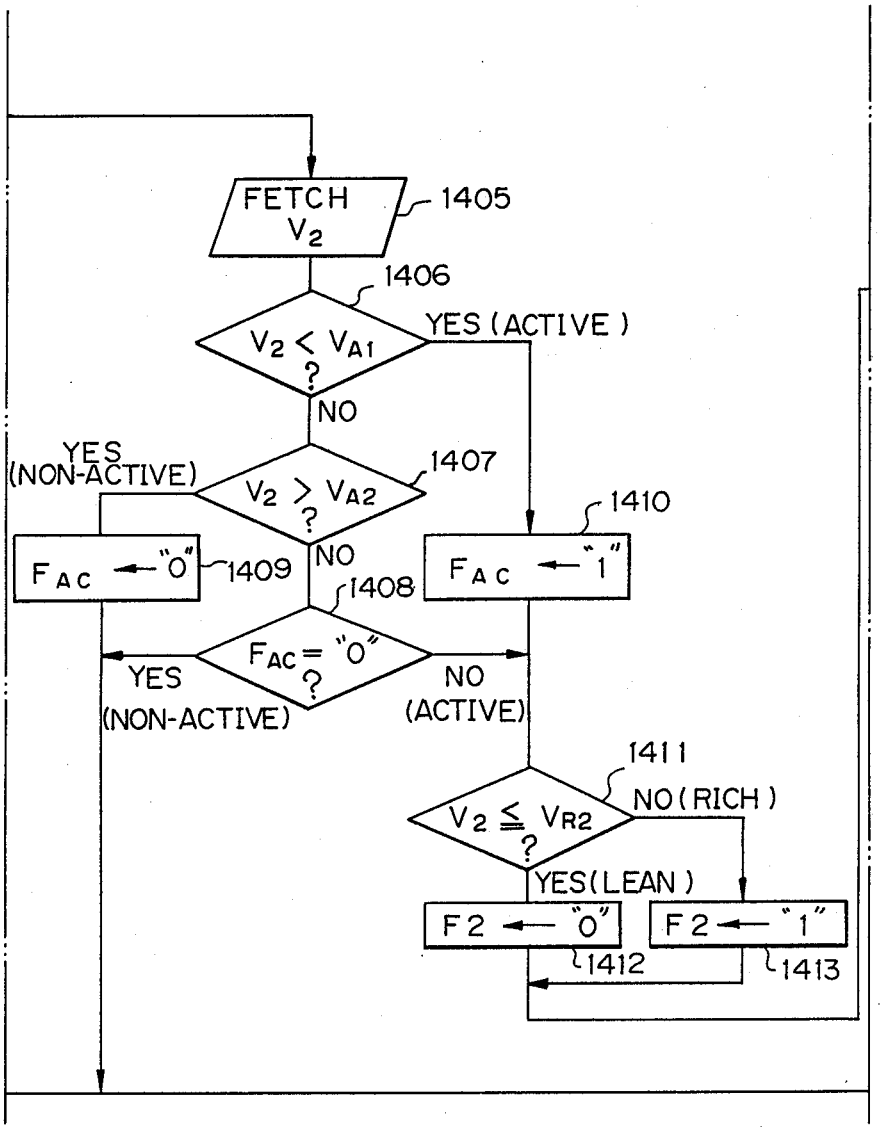
Figure 14C:
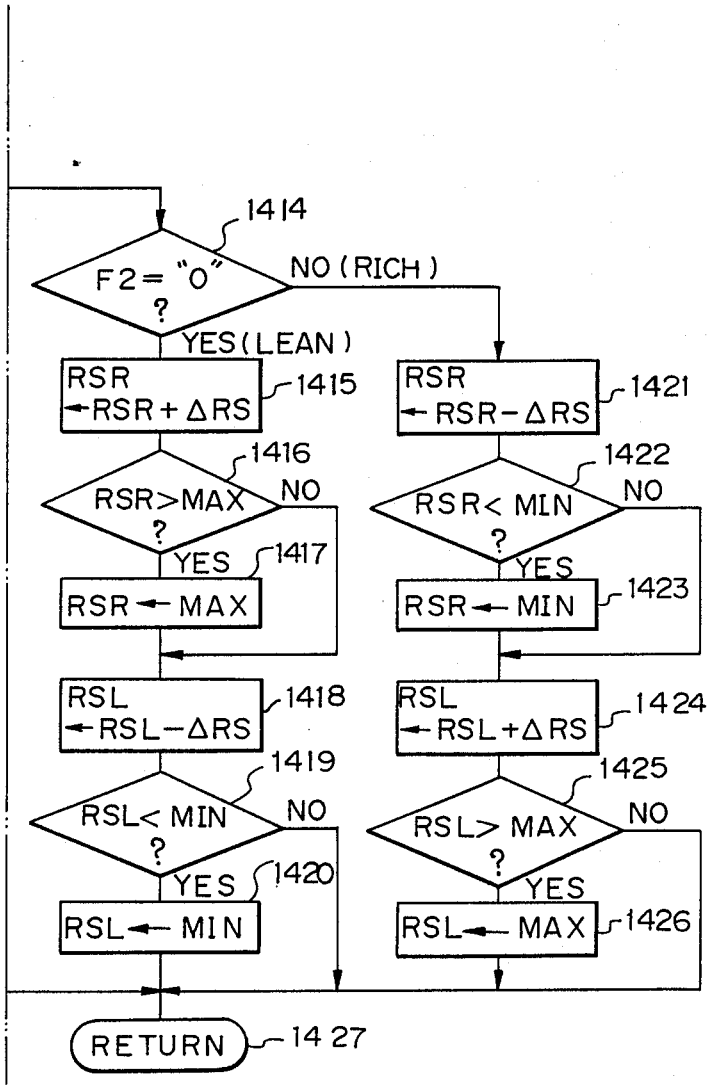

FIG. 14 is a routine for calculating the skip amounts RSR and RSL in accordance with the output of the downstream-side $O_2$ sensor 15 executed at every predetermined time period such as 1 s.

Steps 1401 through 1413 are the same as steps 1001 through 1012 of FIG. 10. That is, if one or more of the feedback control conditions is not satisfied, or if the activation flag $F_{AC}$ is "0", the control proceeds directly to step 1427, thereby carrying out an open-loop control operation. Note that, in this case, the amounts RSR and RSL or the mean values RSR and RSL thereof are stored in the backup RAM 106, and in an open-loop control operation, the values RSR and RSL or RSR and RSL are read out of the backup RAM 106.

Contrary to the above, if all of the feedback control conditions are satisfied and the activation flag $F_{AC}$ is "1", the control proceeds to steps 1414 through 1426.

At step 1414, it is determined whether or not the second air-fuel ratio F2 is "0". If F2="0", which means that the air-fuel ratio downstream of the catalyst converter 12 is lean, the control proceeds to steps 1415 through 1420, and if F2="1", which means that the air-fuel ratio is rich,- the control proceeds to steps 1421 through 1426.

At step 1415, the rich skip amount RSR is increased by ΔRS to move the air-fuel ratio to the rich side. At steps 1415 and 1416, the rich skip amount RSR is guarded by a maximum value MAX which is, for example, 7.5%.

At step 1418, the lean skip amount RSL is decreased by ΔRS to move the air-fuel ratio to the rich side. At steps 1419 and 1420, the lean skip amount RSL is guarded by a minimum value MIN which is, for example, 2.5%.

On the other hand, if F2="1" (rich), at step 1421, the rich skip amount RSR is decreased by ΔRS to move the air-fuel ratio to the lean side. At steps 1422 and 1423, the rich skip amount RSR is guarded by the minimum value MIN. Further, at step 1424, the lean skip amount RSL is decreased by the definite value ΔRS to move the air-fuel ratio to the rich side. At steps 1425 and 1426, the lean skip amount RSL is guarded by the maximum value MAX.

The skip amounts RSR and RSL are then stored in the backup RAM 106, thereby completing this routine of FIG. 14 at step 1427.

In FIG. 14, the minimum value MIN is a level by which the transient characteristics of the skip operation using the amounts RSR and RSL can be maintained, and the maximum value MAX is a level by which the drivability is not deteriorated by the fluctuation of the air-fuel ratio.

Figure 15:
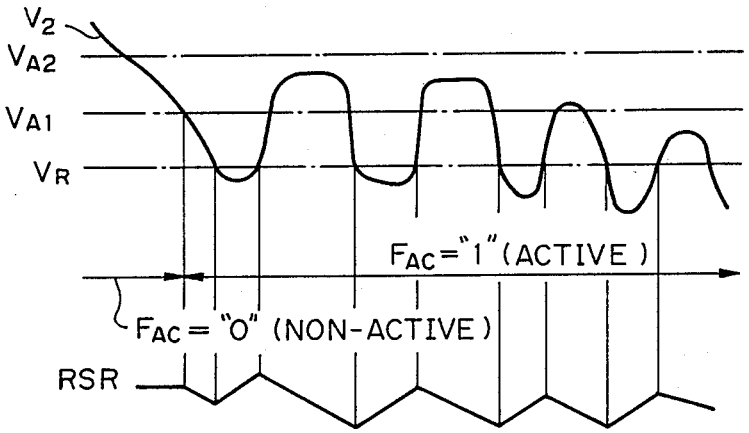

According to the routine of FIG. 14, as illustrated in FIG. 15, when the output $V_2$ of the downstream-side $O_2$ sensor 15, i.e., the output of the pull-up type input circuit 112, is changed so that $V_2 < V_{A1}$ is satisfied, the downstream-side $O_2$ sensor 15 is determined to be in an activation state ($F_{AC}$="1"). Nevertheless, unless $V_2 > V_{A2}$ is satisfied, the downstream-side $O_2$ sensor 15 is determined to be in a non-activation state. Therefore, the skip amount RSR (RSL) cannot be overcorrected to the rich side.

Figure 16:
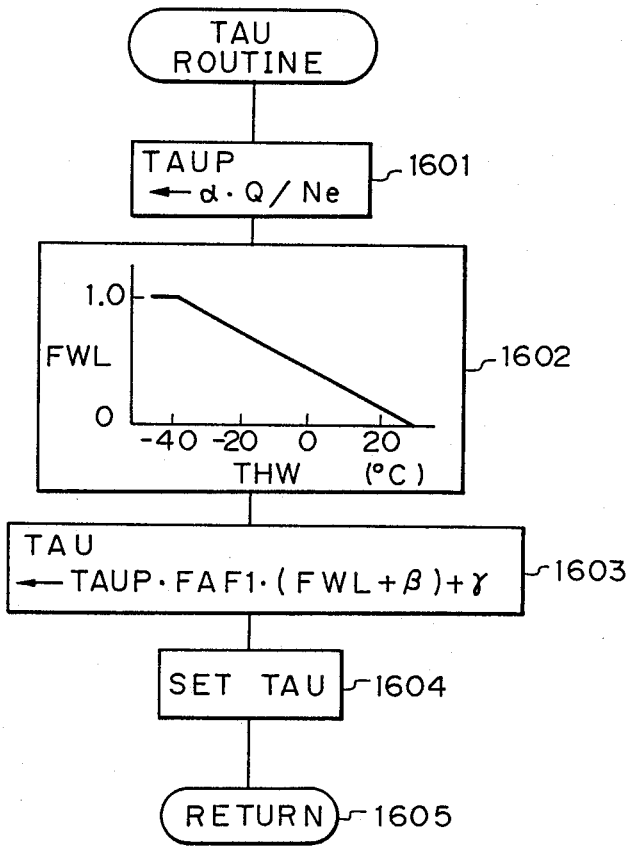

FIG. 16 is a routine for calculating a fuel injection amount TAU executed at every predetermined crank angle such as 360° CA. At step 1601, a base fuel injection amount TAUP is calculated by using the intake air amount data Q and the engine speed data Ne stored in the RAM 105. That is, $$TAUP \leftarrow \alpha \cdot Q/Ne$$

where $\alpha$ is a constant. Then at step 1602, a warming-up incremental amount FWL is calculated from a one-dimensional map by using the coolant temperature data THW stored in the RAM 105. Note that the warming-up incremental amount FWL decreases when the coolant temperature THW increases. At step 1603, a final fuel injection amount TAU is calculated by $$TAU \leftarrow TAUP \cdot FAF1 \cdot (FWL + \beta) + \gamma$$

where $\beta$ and $\gamma$ are correction factors determined by other parameters such as the voltage of the battery and the temperature of the intake air. At step 1604, the final fuel injection amount TAU is set in the down counter 108, and in addition, the flip-flop 109 is set to initiate the activation of the fuel injection valve 7. This routine is then completed by step 1405. Note that, as explained above, when a time period corresponding to the amount TAU has passed, the flip-flop 109 is reset by the borrow-out signal of the down counter 108 to stop the activation of the fuel injection valve 7.

The present invention is also applied to a single $O_2$ sensor system where only one $O_2$ sensor 15 is provided downstream of or within the catalyst converter 12. In this case, the routines of FIGS. 8, 14, and 16 are not used, while the routines of FIGS. 10 and 13 are used. Also, at step 1303 of FIG. 13, the time period TAU is calculated by $$TAU \leftarrow TAUP \cdot FAF2 \cdot (FWL + \beta) + \gamma.$$

Figure 7A:
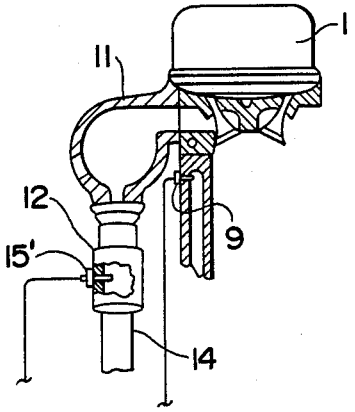
FIG. 7A is a partial view of an internal combustion engine showing a modification to the engine of FIG. 7.

FIG. 7A shows a modification to the positioning of an air-fuel ratio sensor disposed in relation to the catalyst converter. In this alternative embodiment, one $O_2$ sensor 15' is provided within the catalyst converter 12 in order to detect the concentration of oxygen composition in the exhaust gas. The $O_2$ sensor 15' generates output voltage signals and transmits the signals in a manner similar to $O_2$ sensor 15 described above with reference to FIG. 7.

Note that the first air-fuel ratio feedback control by the upstream-side $O_2$ sensor 13 is carried out at every relatively small time period, such as 4 ms, and the second air-fuel ratio feedback control by the downstream-side $O_2$ sensor 15 is carried out at every relatively large time period, such as 1 s. That is because the upstream-side $O_2$ sensor 13 has good response characteristics when compared with the downstream-side $O_2$ sensor 15.

Further, the present invention can be applied to a double $O_2$ sensor system in which other air-fuel ratio feedback control parameters, such as the integration amounts KIR and KIL, the delay time periods TDR and TDL, or the reference voltage $V_{R1}$, are variable.

Still further, a Karman vortex sensor, a heat-wire type flow sensor, and the like can be used instead of the airflow meter.

Although in the above-mentioned embodiments, a fuel injection amount is calculated on the basis of the intake air amount and the engine speed, it can be also calculated on the basis of the intake air pressure and the engine speed, or the throttle opening and the engine speed.

Further, the present invention can be also applied to a carburetor type internal combustion engine is which the air-fuel ratio is controlled by an electric air control value (EACV) for adjusting the intake air amount; by an electric bleed air control valve for adjusting the air bleed amount supplied to a main passage and a slow passage; or by adjusting the secondary air amount introduced into the exhaust system. In this case, the base fuel injection amount corresponding to TAUP at step 1301 of FIG. 13 or at step 1601 or FIG. 16 is determined by the carburetor itself, i.e., the intake air negative pressure and the engine speed, and the air amount corresponding to TAU at step 1303 of FIG. 13 or at step 1603 of FIG. 16.

Further, a CO sensor, a lean-mixture sensor or the like can be also used instead of the $O_2$ sensor.

As explained above, according to the present invention, since the determination of activation and non-activation of an air-fuel ratio sensor downstream of or within a catalyst converter is hysteretically carried out, the hunting of the determination of activation and non-activation of the air-fuel ratio sensor is reduced, thus avoiding an overcorrection of the air-fuel ratio control amount such as the second air-fuel ratio correction amount and the air-fuel ratio feedback control parameter, which can improve the emission characteristics, the fuel consumption characteristics, the drivability characteristics, and the like.

I claim:

1. A method for controlling an air-fuel ratio in an internal combustion engine having a catalyst converter for removing pollutants in the exhaust gas thereof, upstream-side and downstream-side air-fuel ratio sensors disposed upstream and downstream, respectively, of said catalyst converter, for detecting a concentration of a specific component in the exhaust gas, and a pull-up type input circuit for supplying a differential current to said downstream-side air-fuel ratio sensor and receiving an output of said downstream-side air-fuel ratio sensor, comprising the steps of:

comparing an output of said pull-up type input circuit with a first level which is slightly higher than a rich state level of said pull-up type input circuit after said engine is warmed-up;

comparing the output of said pull-up type input circuit with a second level higher than said first level;

determining that said downstream-side air-fuel ratio sensor is in an activation state when the output of said pull-up type input circuit is lower than said first level;

determining that said downstream-side air-fuel ratio sensor is in a non-activation state when the output of said pull-up type input circuit is higher than said second level;

determining that said downstream-side air-fuel ratio sensor is in a previous state when the output of said pull-up type input circuit is between said first and second levels; and adjusting an actual air-fuel ratio in accordance with the outputs of said upstream-side and downstream-side air-fuel ratio sensors when said downstream-side air-fuel ratio sensor is in an activation state.

2. A method as set forth in claim 1, wherein said pull-up circuit comprises:

a resistor connected between an output of said downstream-side air-fuel ratio sensor and a high power supply terminal; and a capacitor connected between the output of said downstream-side air-fuel ratio sensor and a low power supply terminal, the connection node of said resistor and said capacitor serving as the output of said pull-up type input circuit.

3. A method as set forth in claim 1, wherein said actual air-fuel ratio adjusting step comprises the steps of:

calculating a first air-fuel ratio correction amount in accordance with the output of said upstream-side air-fuel ratio sensor;

calculating a second air-fuel ratio correction amount in accordance with the output of said downstream-side air-fuel ratio sensor; and adjusting said actual air-fuel ratio in accordance with said first and second air-fuel ratio correction amounts.

4. A method as set forth in claim 1, wherein said actual air-fuel ratio adjusting step comprises the steps of:

calculating an air-fuel ratio feedback control parameter in accordance with the output of said downstream-side air-fuel ratio sensor;

calculating an air-fuel ratio correction amount in accordance with the output of said upstream-side air-fuel ratio sensor and said air-fuel ratio feedback control parameter; and adjusting said actual air-fuel ratio in accordance with said air-fuel ratio correction amount.

5. A method as set forth in claim 4, wherein said air-fuel ratio feedback control parameter is defined by a lean skip amount by which said air-fuel ratio correction amount is skipped down when the output of said upstream-side air-fuel ratio sensor is switched from the lean side to the rich side and a rich skip amount by which said air-fuel ratio correction amount is skipped up when the output of said downstream-side air-fuel ratio sensor is switched from the rich side to the lean side.

6. A method as set forth in claim 4, wherein said air-fuel ratio feedback control parameter is defined by a lean integration amount by which said air-fuel ratio correction amount is gradually decreased when the output of said upstream-side air-fuel ratio sensor is on the rich side and a rich integration amount by which said air-fuel ratio correction amount is gradually increased when the output of said upstream-side air-fuel ratio sensor is on the lean side.

7. A method as set forth in claim 4, wherein said air-fuel ratio feedback control parameter is determined by a rich delay time period for delaying the output of said upstream-side air-fuel ratio sensor switched from the lean side to the rich side and a lean delay time period for delaying the output of said upstream-side air-fuel ratio sensor switched from the rich side to the lean side.

8. A method as set forth in claim 4, wherein said air-fuel ratio feedback control parameter is determined by a reference voltage with which the output of said upstream-side air-fuel ratio sensor is compared, thereby determining whether the air-fuel ratio is on the rich side or on the lean side.

9. A method for controlling an air-fuel ratio in an internal combustion engine having a catalyst converter for removing pollutants in the exhaust gas thereof, an air-fuel ratio sensor disposed downstream of or within said catalyst converter, for detecting a concentration of a specific component in the exhaust gas, and a pull-up type input circuit for supplying a differential current to said air-fuel ratio sensor and receiving an output of said air-fuel ratio sensor, comprising the steps of:

comparing the output of said pull-up type input circuit with a first level which is slightly higher than a rich state level of said pull-up input circuit after said engine is warmed-up;

comparing the output of said pull-up type input circuit with a second level higher than said first level;

determining that said downstream-side air-fuel ratio sensor is in an activation state when the output of said pull-up type input circuit is lower than said first level;

determining that said downstream-side air-fuel ratio sensor is in a non-activation state when the output of said pull-up type input circuit is higher than said second level;

determining that said downstream-side air-fuel ratio sensor is in a previous state when the output of said pull-up type input circuit is between said first and second levels; and adjusting an actual air-fuel ratio in accordance with the output of said downstream-side air-fuel ratio sensor when said air-fuel ratio sensor is in an activation state.

10. A method as set forth in claim 9, wherein said pull-up circuit comprises:

a resistor connected between the output of said downstream-side air-fuel ratio sensor and a high power supply terminal; and a capacitor connected between the output of said downstream-side air-fuel ratio sensor and a low power supply terminal, the connection node of said resistor and said capacitor serving as the output of said pull-up type input circuit.

11. A method as set forth in claim 9, wherein said actual air-fuel ratio adjusting step comprises the steps of:

calculating an air-fuel ratio correction amount in accordance with the output of said air-fuel ratio sensor; and adjusting said actual air-fuel ratio in accordance with said air-fuel ratio correction amount.

12. An apparatus for controlling an air-fuel ratio in an internal combustion engine having a catalyst converter for removing pollutants in the exhaust gas thereof, upstream-side and downstream-side air-fuel ratio sensors disposed upstream and downstream, respectively, of said catalyst converter, for detecting a concentration of a specific component in the exhaust gas, and a pull-up type input circuit for supplying a differential current to said downstream-side air-fuel ratio sensor and receiving an output of said downstream-side air-fuel ratio sensor, comprising:

means for comprising the output of said pull-up type input circuit with a first value which is slightly higher than a rich state level of said pull-up type input circuit after said engine is warmed-up;

means for comprising the output of said pull-up type input circuit with a second value higher than said first value;

means for determining that said downstream-side stream-side air-fuel ratio sensor is in an activation state when the output of said pull-up type input circuit is lower than said first value;

determining that said downstream-side air-fuel ratio sensor is in a non-activation state when the output of said pull-up type input circuit is higher than said second value;

means for determining that said downstream-side stream-side air-fuel ratio sensor is in a previous state when the output of said pull-up type input circuit is between said first and second values; and means for adjusting an actual air-fuel ratio in accordance with the outputs of said upstream-side and downstream-side air-fuel ratio sensors when said downstream-side air-fuel ratio sensor is in an activation state.

13. An apparatus as set forth in claim 12, wherein said pull-up circuit comprises:

a resistor connected between the output of said downstream-side air-fuel ratio sensor and a high power supply terminal; and a capacitor connected between the output of said downstream-side air-fuel ratio sensor and a low power supply terminal, the connection node of said resistor and said capacitor serving as the output of said pull-up type input circuit.

14. An apparatus as set forth in claim 12, wherein said actual air-fuel ratio adjusting means comprises:

means for calculating a first air-fuel ratio correction amount in accordance with the output of said upstream-side air-fuel ratio sensor;

means for calculating a second air-fuel ratio correction amount in accordance with the output of said downstream-side air-fuel ratio sensor; and means for adjusting said actual air-fuel ratio in accordance with said first and second air-fuel ratio correction amounts.

15. A method as set forth in claim 12, wherein said actual air-fuel ratio adjusting means comprises:

means for calculating an air-fuel ratio feedback control parameter in accordance with the output of said downstream-side air-fuel ratio sensor;

means for calculating an air-fuel ratio correction amount in accordance with the output of said upstream-side air-fuel ratio sensor and said air-fuel ratio feedback control parameter; and means for adjusting said actual air-fuel ratio in accordance with said air-fuel ratio correction amount.

16. A method as set forth in claim 15, wherein said air-fuel ratio feedback control parameter is defined by a lean skip amount by which said air-fuel ratio correction amount is skipped down when the output of said upstream-side air-fuel ratio sensor is switched from the lean side to the rich side and a rich skip amount by which said air-fuel ratio correction amount is skipped up when the output of said downstream-side air-fuel ratio sensor is switched from the rich side to the lean side.

17. A method as set forth in claim 15, wherein said air-fuel ratio feedback control parameter is defined by a lean integration amount by which said air-fuel ratio correction amount is gradually decreased when the output of said upstream-side air-fuel ratio sensor is on the rich side and a rich integration amount by which said air-fuel ratio correction amount is gradually increased when the output of said upstream-side air-fuel ratio sensor is on the lean side.

18. A method as set forth in claim 15, wherein said air-fuel ratio feedback control parameter is determined by a rich delay time period for delaying the output of said upstream-side air-fuel ratio sensor switched from the lean side to the rich side and a lean delay time period for délaying the output of said upstream-side air-fuel ratio sensor switched from the rich side to the lean side.

19. A method as set forth in claim 15, wherein said air-fuel ratio feedback control parameter is determined by a reference voltage with which the output of said upstream-side air-fuel ratio sensor is compared, thereby determining whether the air-fuel ratio is on the rich side or on the lean side.

20. A method for controlling an air-fuel ratio in an internal combustion engine having a catalyst converter for removing pollutants in the exhaust gas thereof, an air-fuel ratio sensor disposed downstream of or within said catalyst converter, for detecting a concentration of a specific component in the exhaust gas, and a pull-up type input circuit for supplying a differential current to said air-fuel ratio sensor and receiving an output of said air-fuel ratio sensor, comprising:

means for comparing the output of said pull-up type input circuit with a first value which is slightly higher than a rich state level of said pull-up input circuit after said engine is warmed-up;

means for comparing the output of said pull-up type input circuit with a second value higher than said first value;

means for determining that said downstream-side stream-side air-fuel ratio sensor is in an activation state when the output of said pull-up type input circuit is lower than said first value;

determining that said downstream-side air-fuel ratio sensor is in a non-activation state when the output of said pull-up type input circuit is higher than said second value, means for determining that said downstream-side air-fuel ratio sensor is in a previous state when the output of said pull-up type input circuit is between said first and second values; and means for adjusting an actual air-fuel ratio in accordance with the output of said downstream-side air-fuel ratio sensor when said air-fuel ratio sensor is in an activation state.

21. An apparatus as set forth in claim 20, wherein said pull-up circuit comprises:

a resistor connected between the output of said downstream-side air-fuel ratio sensor and a high power supply terminal; and a capacitor connected between the output of said downstream-side air-fuel ratio sensor and a low power supply terminal, the connection node of said resistor and said capacitor serving as the output of said pull-up type input circuit.

22. A method as set forth in claim 20, wherein said actual air-fuel ratio adjusting means comprises:

means for calculating an air-fuel ratio correction amount in accordance with the output of said air-fuel ratio sensor; and means for adjusting said actual air-fuel ratio in accordance with said air-fuel ratio correction amount.

* * * * *